US009061792B2

(12) United States Patent
Smith

(10) Patent No.: US 9,061,792 B2
(45) **Date of Patent: *Jun. 23, 2015**

(54) REINFORCED POLYGONAL CONTAINERS AND BLANKS FOR MAKING THE SAME

(71) Applicant: Rock-Tenn Shared Services, LLC, Norcross, GA (US)

(72) Inventor: Kenneth Charles Smith, Hiram, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/471,771

(22) Filed: Aug. 28, 2014

(65) Prior Publication Data

US 2014/0367459 A1 Dec. 18, 2014

Related U.S. Application Data

(63) Continuation of application No. 12/256,051, filed on Oct. 22, 2008, now Pat. No. 8,820,618.

(60) Provisional application No. 61/051,302, filed on May 7, 2008.

(51) Int. Cl.
*B65D 5/44* (2006.01)
*B31B 3/00* (2006.01)
(Continued)

(52) U.S. Cl.
CPC . *B65D 5/443* (2013.01); *B31B 3/00* (2013.01); *B65D 5/28* (2013.01); *B65D 5/4608* (2013.01); *B65D 5/6632* (2013.01)

(58) Field of Classification Search
USPC ..... 229/109, 192, 918, 920, 177, 179
See application file for complete search history.

(56) References Cited

U.S. PATENT DOCUMENTS 2,522,597 A 9/1950 Blandford
2,832,270 A 4/1958 Pierce, Jr. et al.
(Continued)

FOREIGN PATENT DOCUMENTS

WO 9714552 A1 4/1997

OTHER PUBLICATIONS

An International Search Report and Written Opinion, dated Nov. 13, 2014, for International application No. PCT/US14/37546 (16 pgs).
(Continued)

*Primary Examiner* — Gary Elkins
*Assistant Examiner* — Christopher Demeree
(74) *Attorney, Agent, or Firm* — Armstrong Teasdale LLP

(57) ABSTRACT

A blank of sheet material for forming a polygonal container is provided. The blank includes a bottom panel, two opposing side panels each extending from a side edge of the bottom panel, two opposing end panels each extending from an end edge of the bottom panel, and a reinforcing panel assembly extending from a first side edge of a first side panel of the two side panels. The reinforcing panel assembly includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel.

27 Claims, 19 Drawing Sheets

(51) Int. Cl.

| | |
|---|---|
| ***B65D 5/28*** | (2006.01) |
| ***B65D 5/468*** | (2006.01) |
| ***B65D 5/66*** | (2006.01) |

(56) References Cited

U.S. PATENT DOCUMENTS

| | | | |
|---|---|---|---|
| 3,034,698 | A | 5/1962 | Forrer |
| 3,883,067 | A | 5/1975 | McGlynn et al. |
| 3,940,053 | A | 2/1976 | Putman et al. |
| 3,952,634 | A | 4/1976 | Rollins et al. |
| 3,978,774 | A | 9/1976 | Royal |
| 4,056,223 | A | 11/1977 | Williams |
| 4,139,146 | A | 2/1979 | Bamburg et al. |
| 4,211,153 | A | 7/1980 | Nylander et al. |
| 4,215,525 | A | 8/1980 | Nigrelli |
| 4,235,364 | A | 11/1980 | Baker |
| 4,261,254 | A | 4/1981 | Nowacki |
| 4,308,023 | A | 12/1981 | Bidegain |
| 4,345,905 | A | 8/1982 | Moen |
| 4,516,210 | A | 5/1985 | Dahlke |
| 4,581,005 | A | 4/1986 | Moen |
| 4,621,766 | A | 11/1986 | McClure |
| 4,624,653 | A | 11/1986 | McBride et al. |
| 4,636,187 | A | 1/1987 | Oakley |
| 4,674,998 | A | 6/1987 | Benedicenti |
| 4,676,428 | A | 6/1987 | McClure |
| 4,676,429 | A | 6/1987 | Crowe et al. |
| 4,792,084 | A | 12/1988 | Dreeszen |
| 4,843,798 | A | 7/1989 | Focke et al. |
| 4,919,326 | A | 4/1990 | Deiger |
| 4,988,331 | A | 1/1991 | Boisseau |
| 5,000,377 | A | 3/1991 | McClure |
| 5,002,224 | A | 3/1991 | Muise |
| 5,125,567 | A | 6/1992 | McClure |
| 5,131,208 | A | 7/1992 | Paul et al. |
| 5,139,195 | A | 8/1992 | McClure |
| 5,147,271 | A | 9/1992 | Bacques et al. |
| 5,184,998 | A | 2/1993 | Volk et al. |
| 5,207,375 | A | 5/1993 | McClure |
| 5,261,594 | A | 11/1993 | Brown et al. |
| 5,285,956 | A | 2/1994 | Piepho |
| 5,289,970 | A | 3/1994 | McClure |
| 5,289,971 | A | 3/1994 | McClure |
| 5,295,631 | A | 3/1994 | McClure |
| 5,372,569 | A | 12/1994 | Ballos |
| 5,400,955 | A | 3/1995 | Coalier et al. |
| 5,487,504 | A | 1/1996 | Baird |
| 5,535,941 | A | 7/1996 | Garza |
| 5,588,585 | A | 12/1996 | McClure |
| 5,624,031 | A | 4/1997 | Fowler et al. |
| 5,673,848 | A | 10/1997 | Garza |
| 5,687,902 | A | 11/1997 | Tusing et al. |
| 5,752,648 | A | 5/1998 | Quaintance |
| 5,782,732 | A | 7/1998 | Herrin |
| 5,807,223 | A | 9/1998 | Holton |
| 5,807,225 | A | 9/1998 | Nowacki et al. |
| 5,876,319 | A | 3/1999 | Holton |
| 5,950,911 | A | 9/1999 | Naughton et al. |
| 5,971,906 | A | 10/1999 | Tharpe, Jr. et al. |
| 5,996,885 | A | 12/1999 | Chu |
| 6,015,084 | A | 1/2000 | Mathieu et al. |
| 6,131,805 | A | 10/2000 | Gasior |
| 6,223,978 | B1 | 5/2001 | Drager |
| 6,319,183 | B1 | 11/2001 | Ballos, III |
| 6,367,690 | B1 | 4/2002 | McClure |
| 6,402,020 | B1 | 6/2002 | McClure |
| 6,575,356 | B2 | 6/2003 | McClure |
| 6,595,411 | B2 | 7/2003 | McClure |
| 6,651,875 | B2 | 11/2003 | Chu |
| 7,152,777 | B2 | 12/2006 | McClure |
| 7,207,473 | B2 | 4/2007 | Fry |
| 7,290,696 | B2 | 11/2007 | McClure |
| 7,458,503 | B2 | 12/2008 | Fry |
| 7,470,225 | B2 | 12/2008 | Herrin |
| 7,470,226 | B1 | 12/2008 | Herrin |
| 7,559,884 | B2 | 7/2009 | Kisch |
| 7,628,313 | B2 | 12/2009 | Fry |
| 7,677,434 | B2 | 3/2010 | Fry |
| 7,857,743 | B2 | 12/2010 | Barner |
| 7,922,069 | B2 | 4/2011 | Gardner |
| 7,935,041 | B2 | 5/2011 | Graham et al. |
| 8,087,569 | B2 | 1/2012 | Ledvina |
| 8,105,223 | B2 | 1/2012 | Graham et al. |
| 8,128,547 | B2 | 3/2012 | Graham et al. |
| 2005/0067478 | A1 | 3/2005 | McClure |
| 2005/0137072 | A1 | 6/2005 | Jackson |
| 2007/0000985 | A1 | 1/2007 | McClure |
| 2007/0000986 | A1 | 1/2007 | McClure |
| 2007/0228119 | A1 | 10/2007 | Barner |
| 2008/0000784 | A1 | 1/2008 | McClure |
| 2009/0266873 | A1 | 10/2009 | Ledvina |
| 2009/0277952 | A1 | 11/2009 | Smith |
| 2009/0280973 | A1 | 11/2009 | Graham et al. |
| 2011/0281705 | A1 | 11/2011 | Aganovic et al. |
| 2012/0100977 | A1 | 4/2012 | Graham et al. |

OTHER PUBLICATIONS

An International Search Report and Written Opinion, dated Nov. 13, 2014, for International application No. PCT/US14/37542 (19 pgs).

REINFORCED POLYGONAL CONTAINERS AND BLANKS FOR MAKING THE SAME

CROSS REFERENCE TO RELATED APPLICATIONS

This patent application is a continuation application of U.S. patent application Ser. No. 12/256,051, filed Oct. 22, 2008, entitled "REINFORCED POLYGONAL CONTAINERS AND BLANKS FOR MAKING THE SAME," which claims priority to U.S. Provisional Patent Application Ser. No. 61/051,302, filed on May 7, 2008, the disclosures of each of which are hereby incorporated by reference in their entireties.

BACKGROUND OF THE INVENTION

The field of the invention relates generally to a blank and a reinforced polygonal container formed from the blank and more particularly, to a blank for forming a reinforced polygonal container for transporting a product stored within the container.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, it is difficult to form a container from a single sheet of material that includes multiple reinforcing panels along the corner and side walls. Accordingly, a need exists for a multi-sided reinforced container, also known as a mitered tray and/or a Meta Tray 8™ (Meta Tray 8 is a trademark of Smurfit-Stone Container Corporation located in Chicago, Ill.), formed from a single blank that can be easily formed at high-speeds.

BRIEF DESCRIPTION OF THE INVENTION

In one aspect, a blank of sheet material for forming a polygonal container is provided. The blank includes a bottom panel, two opposing side panels extending from each side edge of the bottom panel, two opposing end panels extending from each end edge of the bottom panel, and a reinforcing panel extending from a first side edge of a first side panel of the two side panels. The reinforcing panel includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel.

In another aspect, a polygonal container formed from a blank of sheet material is provided. The container includes a bottom wall, two opposing side walls emanating from the bottom wall, two opposing end walls emanating from the bottom wall, and a first corner wall extending between a first end wall of the two end walls and a first side wall of the two side walls. The first corner wall includes a corner panel and an inner reinforcing corner panel in at least partially overlying relationship.

In yet another aspect, a method for forming a polygonal container from a blank of sheet material is provided. The polygonal container includes at least five sides. The blank includes a bottom panel, two opposing side panels each extending from a side edge of the bottom panel, two opposing end panels each extending from an end edge of the bottom panel, and a reinforcing panel assembly extending from a first side edge of a first side panel of the two side panels. The reinforcing panel assembly includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel. The method includes rotating the second reinforcing end panel toward an interior surface of the first reinforcing end panel about a fold line connecting the second reinforcing end panel and the first reinforcing end panel, said rotating aligning the first and second reinforcing end panels in a substantially face-to-face relationship, the corner panel and the inner reinforcing corner panel in a substantially face-to-face relationship, and the inner side panel and the first side panel in a substantially face-to-face relationship. The first and second reinforcing end panels are rotated toward an interior surface of the first side panel about a fold line connecting the second reinforcing end panel and the inner reinforcing corner panel and about a fold line connecting the first reinforcing end panel and the corner panel. The corner panel and the inner reinforcing corner panel are rotated toward the interior surface of the first side panel about a fold line connecting the inner reinforcing corner panel and the inner side panel and about a fold line connecting the corner panel and the first side panel. The first side panel is rotated inward into a substantially perpendicular relationship with the bottom panel about a fold line connecting the first side panel and the bottom panel. The first side panel and inner side panel forms a first side wall of the polygonal container and the corner panel, and the inner reinforcing corner panel forms a first corner wall of the polygonal container.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, reinforced container formed from a single sheet of material, and a method for constructing the container. The container is sometimes referred to as a reinforced mitered tray or a reinforced eight-sided tray. The container may be constructed from a blank of sheet material using a machine. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

Figure 1:
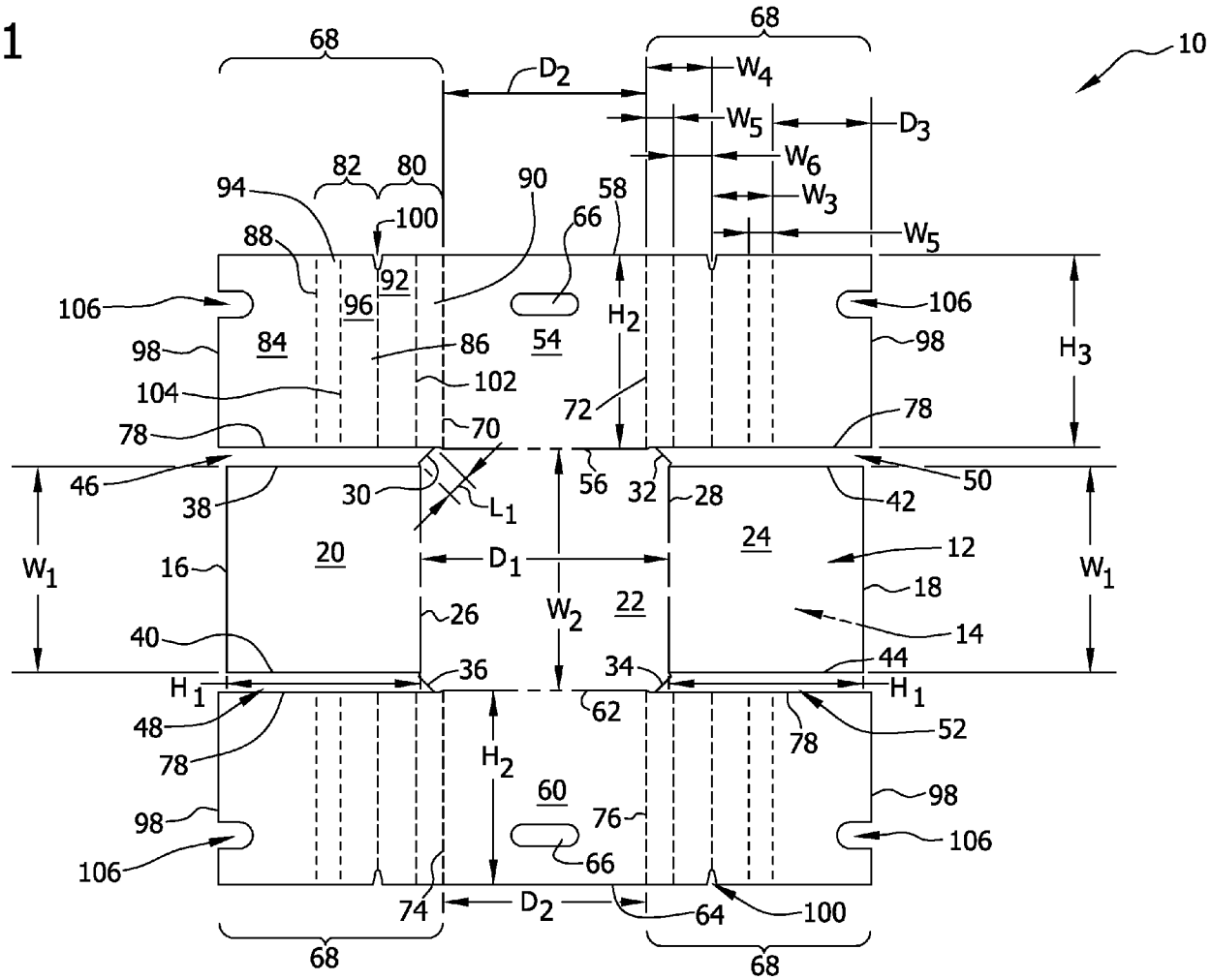
FIG. 1 is a top plan view of a blank of sheet material for constructing a container according to a first embodiment of the present invention.

Referring now to the drawings, and more specifically to FIG. 1, which is a top plan view of an example embodiment of a blank 10 of sheet material. A container 150 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a front panel 20, a bottom panel 22, and a rear panel 24, coupled together along preformed, generally parallel, fold lines 26 and 28, respectively. Front panel 20 and rear panel 24 are also considered to be end panels. The container formed from blank 10 may be referred to as an open-top reinforced mitered tray.

More specifically, front panel 20 extends from leading edge 16 to fold line 26, bottom panel 22 extends from front panel 20 along fold line 26, rear panel 24 extends from bottom panel 22 along fold line 28 to trailing edge 18. Fold lines 26 and/or 28, as well as other fold lines and/or hinge lines described herein, may include any suitable line of weakening and/or line of separation known to those skilled in the art and guided by the teachings herein provided. Front and rear panels 20 and 24 may be considered to be end panels. When container 150 is formed from blank 10, fold line 26 defines a bottom edge of front panel 20 and a front edge, or first end edge, of bottom panel 22, and fold line 28 defines a rear edge, or second end edge, of bottom panel 22 and a bottom edge of rear panel 24. As used through this description, front edges and rear edges are also considered to be end edges.

Front panel 20 and rear panel 24 are substantially congruent and have a rectangular shape. Bottom panel 22 has an octagonal shape. More specifically, front panel 20 and rear panel 24 have a width $W_1$. Bottom panel 22 has a width $W_2$, which is longer that width $W_1$. Alternatively, width $W_1$ is substantially equal to or longer than width $W_2$. Further, in the exemplary embodiment, front and rear panels 20 and 24 have a first height $H_1$, and bottom panel 22 has a first depth $D_1$ that is larger than first height $H_1$. In an alternative embodiment, height $H_1$ is substantially equal to or larger than depth $D_1$. In the exemplary embodiment, front panel 20, rear panel 24, and/or bottom panel 22 are equally dimensioned, however, front panel 20, rear panel 24, and/or bottom panel 22 may be other than equally dimensioned.

In the exemplary embodiment, bottom panel 22 may be considered to be substantially rectangular in shape with four cut-off corners or angled edges 30, 32, 34, and 36 formed by cut lines. As such, the cut-off corner edges of otherwise rectangular bottom panel 22 define an octagonal shape of bottom panel 22. Moreover, each angled corner edge 30, 32, 34, and 36 has a length $L_1$, and angled edges 30 and 34 and angled edges 32 and 36 are substantially parallel. Alternatively, bottom panel 22 has any suitable shape that enables container 150 to function as described herein. For example, bottom panel 22 may be in the shape of a rectangle having corners that are truncated by a segmented edge such that bottom panel 22 has more than eight sides. In another example, bottom panel 22 may be in the shape of a rectangle having corners that are truncated by an arcuate edge such that bottom panel 22 has four substantially straight sides and four arcuate sides.

In the exemplary embodiment, front panel 20 includes two free side edges 38 and 40, and rear panel 24 includes two free side edges 42 and 44. Side edges 38, 40, 42, and 44 are substantially parallel to each other. Alternatively, side edges 38, 40, 42, and/or 44 are other than substantially parallel. In the exemplary embodiment, each side edge 38, 40, 42, and 44 is connected to a respective angled edge 30, 32, 34, or 36. Each side edge 38, 40, 42, and 44 may be directly connected to a respective angled edge 30, 32, 34, or 36 or, as shown in FIG. 1, may be slightly offset from a respective angled edge 30, 32, 34, or 36 to facilitate forming container 150 from blank 10 by allowing clearance for a thickness of a panel that is directly or indirectly attached to front panel 20 or rear panel 24. Side edges 38, 40, 42, and 44 and angled edges 30, 32, 34, and 36 partially define a respective cutout 46, 48, 50, or 52. More specifically, side edge 38 and angled edge 30 partially define cutout 46, side edge 42 and angled edge 32 partially define cutout 50, side edge 44 and angled edge 34 partially define cutout 52, and side edge 40 and angled edge 36 partially define cutout 48.

A first side panel 54 extends from bottom panel 22 along a fold line 56 to a free edge 58, and a second side panel 60 extends from bottom panel 22 along a fold line 62 to a free edge 64. Fold line 56 defines a bottom edge of first side panel 54 and a side edge of bottom panel 22, and fold line 62 defines a bottom edge of second side panel 60 and a side edge of bottom panel 22. First and second side panels 54 and 60 are each generally rectangularly shaped. Side panels 54 and 60 each have a depth $D_2$ that is shorter than depth $D_1$ such that side panels 54 and 60 are narrower than bottom panel 22. In the exemplary embodiment, side panels 54 and 60 each have a height $H_2$ such that height $H_2$ is substantially equal to height $H_1$. Alternatively, height $H_2$ is other than equal to height $H_1$. In the exemplary embodiment, fold line 56 extends between ends of angled corner edges 30 and 32, and fold line 62 extends between ends of angled corner edges 34 and 36. Further, in the exemplary embodiment, an oval shaped cutout 66 is defined within first and second side panels 54 and 60. In an alternative embodiment, cutout 66 may be of any shape and/or defined within any suitable panel, such as front panel 20 and/or rear panel 24. Alternatively, blank 10 does not include cutout 66.

In the exemplary embodiment, a reinforcing panel 68 extends from side edges of each side panel 54 and 60. Reinforcing panel 68 is also referred to herein as a reinforcing panel assembly that includes a plurality of panels as described in more detail herein. Each side edge is defined by a respective fold line 70, 72, 74, or 76. Fold lines 70, 72, 74, and 76 are substantially parallel to each other. Alternatively, fold lines 70, 72, 74, and/or 76 are other than substantially parallel. In the exemplary embodiment, each reinforcing panel 68 includes a free bottom edge 78. Each free bottom edge 78 at least partially defines cutouts 46, 48, 50, and 52. As such, one side edge 38, 40, 42, or 44, a respective angled edge 30, 36, 32, or 34, and a bottom edge 78 of an adjacent reinforcing panel 68 defines cutouts 46, 48, 50, and 52. Further, each reinforcing panel 68 is substantially similar and includes an outer reinforcing wall 80, an inner reinforcing wall 82, and an inner side panel 84 connected along substantially parallel fold lines 86 and 88. Fold line 86 defines a side edge of outer reinforcing wall 80 and a side edge of inner reinforcing wall 82, and fold line 88 defines a side edge of inner reinforcing wall 82 and a side edge of inner side panel 84. Moreover, outer reinforcing wall 80 includes a corner panel 90 and a first reinforcing end panel 92, and inner reinforcing wall 82 includes an inner reinforcing corner panel 94 and a second reinforcing end panel 96.

More specifically, outer reinforcing wall 80 extends along each of fold lines 70, 72, 74, and 76. Further, inner reinforcing wall 82 extends from each outer reinforcing wall 80 along fold line 86, and inner side panel 84 extends from each inner reinforcing wall 82 along fold line 88 to a free edge 98. A notch 100 is formed along fold line 86 between inner reinforcing walls 82 and outer reinforcing walls 80. Inner reinforcing walls 82 and outer reinforcing walls 80 are substantially rectangular in shape. More specifically, inner reinforcing walls 82 have a width $W_3$, and outer reinforcing walls 80 have a width $W_4$, which is substantially equal to width $W_3$. Further, in the exemplary embodiment, inner and outer reinforcing walls have a height $H_3$ that is substantially similar to height $H_1$ of front panel 20 and rear panel 24. In an alternative embodiment, height $H_2$ is other than equal to height $H_3$.

Each outer reinforcing wall 80 includes a fold line 102 that bisects each outer reinforcing wall 80 into corner panel 90 and first reinforcing end panel 92. Fold line 102 defines an edge of corner panel 90 and a side edge of first reinforcing end panel 92, and fold line 86 defines a side edge of first reinforcing end panel 92. In the exemplary embodiment, corner panel 90 and first reinforcing end panel 92 are substantially rectangular. Further, in the exemplary embodiment, each inner reinforcing wall 82 includes a fold line 104 that bisects each inner reinforcing wall 82 into inner reinforcing corner panel 94 and second reinforcing end panel 96. Fold line 104 defines an edge of inner reinforcing corner panel 94 and a side edge of second reinforcing end panel 96, fold line 88 defines a side edge of inner reinforcing corner panel 94, and fold line 86 defines a side edge of second reinforcing end panel 96.

In the exemplary embodiment, inner reinforcing corner panel 94 and second reinforcing end panel 96 are substantially rectangular. Further, corner panel 90 and inner reinforcing corner panel 94 are substantially congruent, and first and second reinforcing end panels 92 and 96 are substantially congruent.

Each corner panel 90 and each inner reinforcing corner panel 94 have a width $W_5$ that is substantially equal to length $L_1$. In addition, each first reinforcing end panel 92 and second reinforcing end panel 96 have a width $W_6$ that is approximately equal to width $W_5$. In an alternative embodiment, width $W_6$ is other than equal to width $W_5$. Further, in the exemplary embodiment, each inner side panel 84 has a depth $D_3$ that is equal to approximately half of the depth $D_2$ of first and second top panels 302 and 304, such that a cutout 106 extending inward from free edge 98 is substantially aligned with at least a portion of cutout 66. In an alternative embodiment, depth $D_3$ is other than equal to approximately half the depth $D_2$. Alternatively, blank 10 does not include cutout 106.

Figure 2:
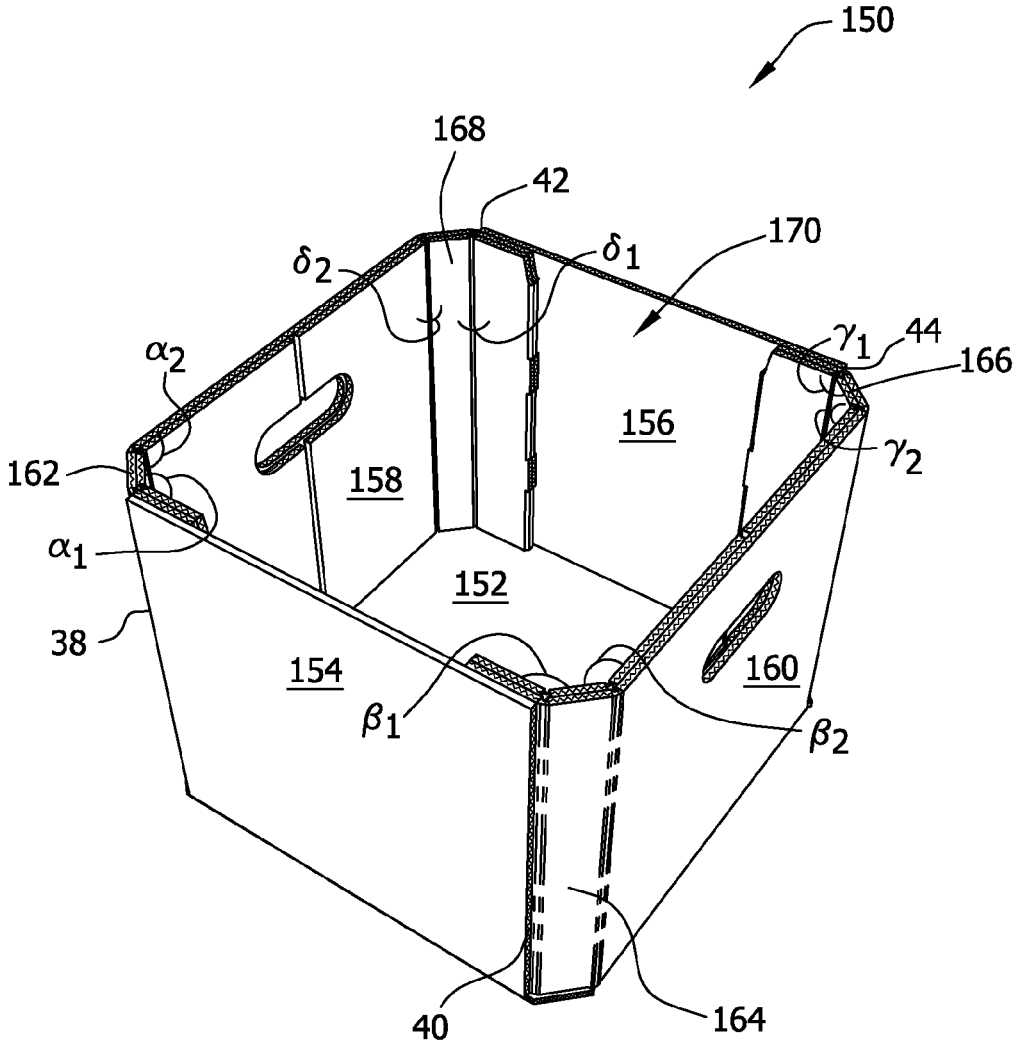
FIG. 2 is a perspective view of a container formed from the blank shown in FIG. 1.

FIG. 2 is a perspective view of container 150 that is formed from blank 10 (shown in FIG. 1). Although container 150 is shown as being formed without a product to be contained therein, container 150 may also be formed having a product therein. Further, container 150 may include any suitable number of products of any suitable shape.

To construct container 150 from blank 10, at least one product is positioned on interior surface 12 of bottom panel 22. In the exemplary embodiment, bottom panel 22 is sized to correspond to product(s) contained within container 150. Each inner side panel 84 and respective inner reinforcing wall 82 are folded about fold line 86 such that inner reinforcing wall 82 and outer reinforcing wall 80 are in an at least partially overlying relationship, and such that inner side panel 84 is in an at least partially overlying relationship with at least a portion of first or second side panel 54 or 60. More specifically, blank 10 is folded along fold line 86 such that corner panel 90 and inner reinforcing corner panel 94 are substantially aligned in an at least partially overlying relationship, first and second reinforcing end panels 92 and 96 are substantially aligned in an at least partially overlying relationship, and inner side panel 84 and at least a portion of first or second side panel 54 or 60 are substantially aligned in an at least partially overlying relationship. In the exemplary embodiment, inner side panel 84, a respective side panel 54 or 60, reinforcing end panels 92 and 96, and/or corner panel 90 and inner reinforcing corner panel 94 are secured in the above-described relationships. For example, inner side panel 84, a respective side panel 54 or 60, reinforcing end panels 92 and 96, and/or corner panel 90 and inner reinforcing corner panel 94 are held against the product to be contained by a force on exterior surface 14 as container 150 continues to be erected. In another example, inner side panel 84 may be adhered to a respective side panel 54 or 60, reinforcing end panels 92 and 96 may be adhered together, and/or corner panels 90 and 94 may be adhered together.

Reinforcing walls 80 and 82 are rotated about fold lines 70, 72, 74, and 76 and fold lines 88. Further, reinforcing end panels 92 and 96 are rotated about fold lines 102 and 104 toward corner panels 90 and 94 before or after reinforcing walls 80 and 82 are rotated about fold lines 70, 72, 74, and 76 and fold lines 88. In the exemplary embodiment, reinforcing walls 80 and 82 and reinforcing end panels 92 and 96 are rotated such that reinforcing end panels are substantially perpendicular to side panels 54 and 60. First and second side panels 54 and 60 are then rotated about fold lines 56 and 62, respectively, toward interior surface 12.

Front panel 20 is rotated about fold line 26 toward interior surface 12, and rear panel 24 is rotated about fold line 28 toward interior surface 12. More specifically, front panel 20 and rear panel 24 are rotated to be substantially perpendicular to bottom panel 22, as shown in FIG. 2. Interior surface 12 of front panel 20 is secured to exterior surface 14 of two adjacent first reinforcing end panels 92, and interior surface 12 of rear panel 24 is secured to exterior surface 14 of two adjacent first reinforcing end panels 92. In the exemplary embodiment, front panel 20 and rear panel 24 are adhered to respective first reinforcing end panels 92. Alternatively, front panel 20 and rear panel 24 are otherwise attached to respective first reinforcing end panels 92 using, for example, fasteners, a bonding material, and/or any suitable method for attached the panels.

When container 150 is formed, interior surface 12 of front and rear panels 20 and 24 is adjacent the side walls of the product. Further, height $H_1$ of front and rear panels 20 and 24 is sized to correspond to a height of the products within container 150 such that height $H_1$ is substantially equal to or greater than the height of the products. Bottom panel 22 forms a bottom wall 152 of container 150, front panel 20 and a pair of reinforcing end panels 92 and 96 forms a front wall 154 of container 150, and rear panel 24 and a pair of reinforcing end panels 92 and 96 forms a rear wall 156 of container 150. Front wall 154 and rear wall 156 are also referred to as end walls of container 150. Side panel 54 and two inner side panels 84 form a first side wall 158, and side panel 60 and two inner side panels 84 form a second side wall 160. Each pair of corner panels 90 and 94 forms first corner wall 162, second corner wall 164, third corner wall 166, and fourth corner wall 168. Bottom wall 152, front wall 154, rear wall 156, first side wall 158, second side wall 160, and corner walls 162, 164, 166, and 168 define a cavity 170 of container 150.

In the exemplary embodiment, first corner wall 162 is oriented at an oblique angle $\alpha 1$ to front wall 154 and an oblique angle $\alpha 2$ to side wall 158. Similarly, second corner wall 164 is oriented at an oblique angle $\beta 1$ to front wall 154 and an oblique angle $\beta 2$ to side wall 160. Similarly, third corner wall 166 is oriented at an oblique angle $\gamma 1$ to rear wall 156 and an oblique angle $\gamma 2$ to side wall 160, and fourth corner wall 168 is oriented at an oblique angle $\delta 1$ to rear wall 156 and an oblique angle $\delta 2$ to side wall 158. In the exemplary embodiment, angles $\alpha 1$, $\alpha 2$, $\beta 1$, $\beta 2$, $\gamma 1$, $\gamma 2$, $\delta 1$, and $\delta 2$ are substantially equal, however, angles $\alpha 1$, $\alpha 2$, $\beta 1$, $\beta 2$, $\gamma 1$, $\gamma 2$, $\delta 1$, and/or $\delta 2$ can be other than equal depending of the products positioned within container 150. Further, in the exemplary embodiment, bottom edges 78 of reinforcing panels 68 are substantially aligned with fold lines 26, 28, 56, and 62 and angled edges 30, 32, 34, and 36. Container 150 has a configuration referred to herein as an "open configuration."

The above-described method to construct container 150 from blank 10 may be performed using a machine, as described in more detail below. The machine performs the above-described method to continuously form container 150 from blank 10 as blank 10 is moved though the machine. In one embodiment, the machine includes at least one plow or finger to at least partially rotate at least one of panels 84, 94, 54, 60, 20, and 24 and/or further form container 150 using a mandrel to complete rotating these panels.

Figure 3:
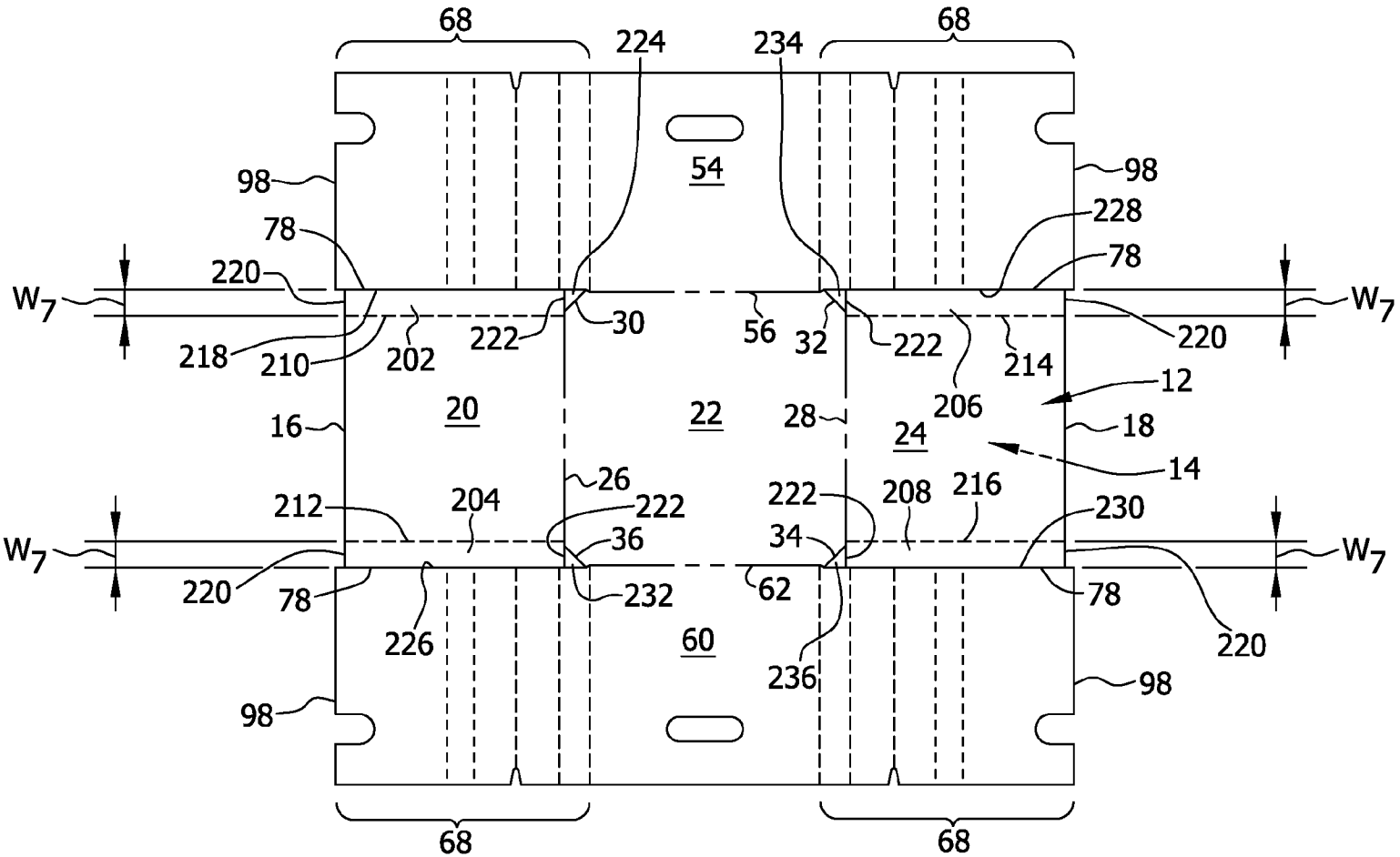
FIG. 3 is a top plan view of a blank of sheet material for constructing a container according to a first alternative embodiment of the present invention.

FIG. 3 is a top plan view of an example embodiment of a blank 200 of sheet material. Blank 200 is essentially similar to blank 10 (shown in FIG. 1) and, as such, similar components are labeled with similar references. More specifically, blank 200 includes outer reinforcing corner panels 202, 204, 206, and 208. Further, blank 200 includes fold lines 210, 212, 214, and 216 rather than free side edges 38, 40, 42, and 44.

In the exemplary embodiment, first outer reinforcing corner panel 202 extends from front panel 20 along fold line 210 to a free edge 218. Fold line 210 and free edge 218 define side edges of first outer reinforcing corner panel 202, and fold line 210 defines a side edge of front panel 20. First outer reinforcing corner panel 202 is substantially rectangular shaped having a top edge 220 and a bottom edge 222. Bottom edge 222, angled edge 30, and bottom edge 78 define a removable cutout 224. Further, first outer reinforcing corner panel 202 has substantially height $H_1$ such that front panel 20 and first outer reinforcing corner panel 202 have a substantially equal height. As such, top edge 220 is substantially collinear with leading edge 16, which defines a top edge of front panel 20, and bottom edge 222 is substantially collinear with fold line 26. Further, first outer reinforcing corner panel 202 has a width $W_7$. Width $W_7$ is substantially equal to length $L_1$. Alternatively, width $W_7$ is less than length $L_1$. In the exemplary embodiment, first outer reinforcing corner panel 202 has substantially constant width $W_7$ from top edge 220 to bottom edge 222 such that first outer reinforcing corner panel 202 does not include cutoff corners and/or tapered top and/or bottom edges.

Similarly, second outer reinforcing corner panel 204 extends from front panel 20 along fold line 212 to a free edge 226, third outer reinforcing corner panel 206 extends from rear panel 24 along fold line 214 to a free edge 228, and fourth outer reinforcing corner panel 208 extends from rear panel 24 along fold line 216 to a free edge 230. In the exemplary embodiment, second outer reinforcing corner panel 204, third outer reinforcing corner panel 206, and fourth outer reinforcing corner panel 208 are each substantially rectangular and have substantially height $H_1$ extending between respective top edges 220 and bottom edges 222 such that front panel 20, rear panel 24, and outer reinforcing corner panels 204, 206, and 208 have an equal height. As such, top edge 220 of second outer reinforcing corner panel 204 is substantially collinear with leading edge 16, bottom edge 222 of second outer reinforcing corner panel 204 is substantially collinear with fold line 26, top edge 220 of third outer reinforcing corner panel 206 is substantially collinear with trailing edge 18, bottom edge 222 of third outer reinforcing corner panel 206 is substantially collinear with fold line 28, top edge 220 of fourth outer reinforcing corner panel 208 is substantially collinear with trailing edge 18, and bottom edge 222 of fourth outer reinforcing corner panel 208 is substantially collinear with fold line 28. Further, bottom edge 222 of second outer reinforcing corner panel 204, angled edge 36, and bottom edge 78 define a removable cutout 232, bottom edge 222 of third outer reinforcing corner panel 206, angled edge 32, and bottom edge 78 define a removable cutout 234, and bottom edge 222 of fourth outer reinforcing corner panel 208, angled edge 34, and bottom edge 78 define a removable cutout 236.

Further, second outer reinforcing corner panel 204, third outer reinforcing corner panel 206, and fourth outer reinforcing corner panel 208 have width $W_7$. Alternatively, outer reinforcing corner panels 202, 204, 206, and/or 208 may have any suitable dimensions that enable blank 10 to function as described herein. In the exemplary embodiment, outer reinforcing corner panels 204, 206, and 208 have substantially constant width $W_7$ from top edges 220 to bottom edges 222 such that corner panels 204, 206, and 208 do not include cutoff corners and/or tapered top and/or bottom edges. Further, second, third, and fourth outer reinforcing corner panels 204, 206, and 208 are substantially congruent to first corner panel 202. Alternatively, corner panels 202, 204, 206, and/or 208 are other than congruent to each other.

In the exemplary embodiment, fold line 210 is generally aligned with an intersection of angled corner edge 30 of bottom panel 22 and fold line 26, fold line 212 is substantially aligned with an intersection of angled corner edge 36 of bottom panel 22 and fold line 26, fold line 214 is substantially aligned with an intersection of angled corner edge 32 of bottom panel 22 and fold line 28, and fold line 216 is substantially aligned with an intersection of angled corner edge 34 of bottom panel 22 and fold line 28. Further, fold lines 210, 212, 214, and 216 are substantially parallel. Moreover, free edges 218, 226, 228, and 230 are substantially parallel with fold lines 210, 212, 214, and 216. Alternatively, free edges 218, 226, 228, and/or 230 and/or fold lines 210, 212, 214, and/or 216 are other than parallel. In the exemplary embodiment, each free edge 218, 226, 228, and 230 is adjacent to and substantially parallel with a bottom edge 78.

Figure 4:
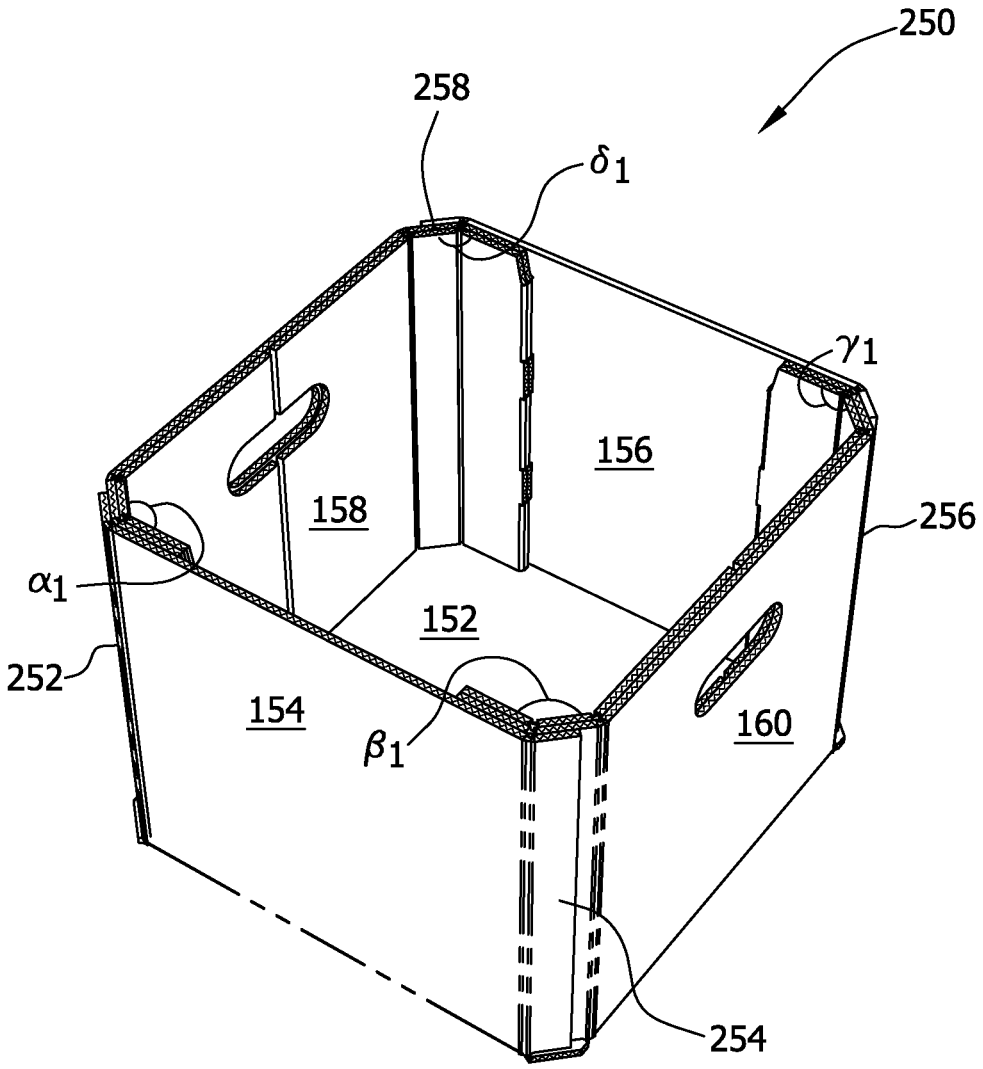
FIG. 4 is a perspective view of a container formed from the blank shown in FIG. 3.

FIG. 4 is a perspective view of container 250 that is formed from blank 200 (shown in FIG. 3). Container 250 is essentially similar to container 150 (shown in FIG. 2) and, as such, similar components are labeled with similar references. Although container 250 is shown as being formed without a product to be contained therein, container 250 may also be formed having a product therein. Further, container 250 may include any suitable number of products of any suitable shape.

To construct container 250 from blank 200 a method that is substantially similar to the method for forming container 150 from blank 10 is used. However, to construct container 250, first outer reinforcing corner panel 202 is rotated about fold line 210 toward interior surface 12 and secured to exterior surface 14 of corner panel 90 extending from fold line 70 of first side panel 54. More specifically, first outer reinforcing corner panel 202 is rotated such that first outer reinforcing corner panel 202 is oriented at oblique angle $\alpha 1$ to front wall 154. Similarly, second outer reinforcing corner panel 204 is rotated about fold line 212 toward interior surface 12 and secured to exterior surface 14 of corner panel 90 extending from fold line 74 of second side panel 60. More specifically, second outer reinforcing corner panel 204 is rotated such that second outer reinforcing corner panel 204 is oriented at oblique angle $\beta 1$ to front wall 154.

In the exemplary embodiment, free edge 218 of first outer reinforcing corner panel 202 is substantially aligned with fold line 70, and free edge 226 of second outer reinforcing corner panel 204 is substantially aligned with fold line 74. Alternatively, first outer reinforcing corner panel 202 and/or second outer reinforcing corner panel 204 only partially overlap corner panels 90 such that free edges 218 and/or 226 are offset from fold lines 70 and/or 74, respectively. Further, in the exemplary embodiment, bottom edge 222 of first outer reinforcing corner panel 202 is substantially aligned with angled edge 30 of bottom panel 22, and bottom edge 222 of second outer reinforcing corner panel 204 is substantially aligned with angled edge 36 of bottom panel 22. First outer reinforcing corner panel 202 forms a first corner wall 252 with a pair of corner panels 90 and 94, and second outer reinforcing corner panel 204 forms a second corner wall 254 with a pair of corner panels 90 and 94.

Third outer reinforcing corner panel 206 is rotated about fold line 214 toward interior surface 12 and secured to exterior surface 14 of corner panel 90 extending from fold line 72 of first side panel 54. More specifically, third outer reinforcing corner panel 206 is rotated such that third outer reinforcing corner panel 206 is oriented at oblique angle $\gamma 1$ to rear wall 156. Similarly, fourth outer reinforcing corner panel 208 is rotated about fold line 216 toward interior surface 12 and secured to exterior surface 14 of first reinforcing panel 90 extending from fold line 76 of second side panel 60. More specifically, fourth outer reinforcing corner panel 208 is rotated such that fourth outer reinforcing corner panel 208 is oriented at oblique angle $\delta 1$ to rear wall 156. In the exemplary embodiment, free edge 228 of third outer reinforcing corner panel 206 is substantially aligned with fold line 72 of first side panel 54, and free edge 230 of fourth outer reinforcing corner panel 208 is substantially aligned with fold line 76 of second side panel 60. Alternatively, third outer reinforcing corner panel 206 and/or fourth outer reinforcing corner panel 208 only partially overlap corner panels 90 such that free edges 228 and/or 230 are offset from fold lines 72 and/or 76, respectively. Further, in the exemplary embodiment, bottom edge 222 of third outer reinforcing corner panel 206 is substantially aligned with angled edge 32 of bottom panel 22, and bottom edge 222 of fourth outer reinforcing corner panel 208 is substantially aligned with angled edge 34 of bottom panel 22. Third outer reinforcing corner panel 206 forms a third corner wall 256 with a pair of corner panels 90 and 94, and fourth outer reinforcing corner panel 208 forms a fourth corner wall 258 with a pair of corner panels 90 and 94. Corner walls 252, 254, 256, and 258 each include three layers of panels, and corner walls 162, 164, 166, and 168 (shown in FIG. 2) each include two layers of panels.

Figure 5:
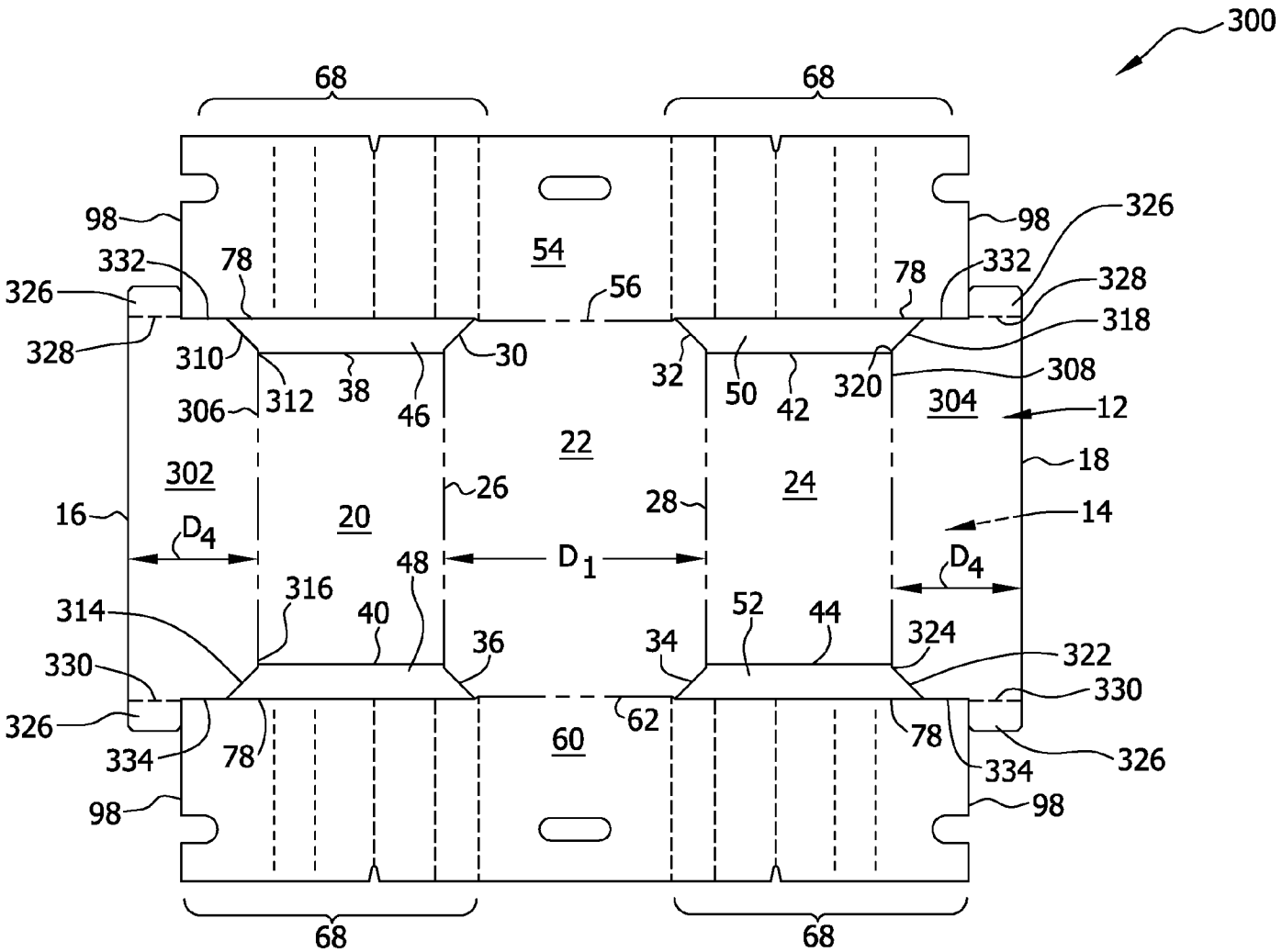
FIG. 5 is a top plan view of a blank of sheet material for constructing a container according to a second alternative embodiment of the present invention.

FIG. 5 is a top plan view of an example embodiment of a blank 300 of sheet material. Blank 300 is essentially similar to blank 10 (shown in FIG. 1) and, as such, similar components are labeled with similar references. More specifically, blank 300 includes top panels 302 and 304. Further, blank 300 includes fold lines 306 and 308 as top edges of front panel 20 and rear panel 24, respectively, rather than leading edge 16 and trailing edge 18 defining top edges of front panel 20 and rear panel 24, respectively.

In the exemplary embodiment, blank 300 includes, in series from leading edge 16 to trailing edge 18, a first top panel 302, front panel 20, bottom panel 22, rear panel 24, and a second top panel 304 coupled together along preformed, generally parallel, fold lines 306, 26, 28, and 308, respectively. More specifically, first top panel 302 extends between leading edge 16 and fold line 306, and second top panel 304 extends from rear panel 24 along fold line 308 to trailing edge 18. When a container 350 (shown in FIG. 6) is formed from blank 300, fold line 306 defines a front edge of top panel 302 and a top edge of front panel 20, and fold line 308 defines a top edge of rear panel 24 and a rear edge of top panel 304.

In the exemplary embodiment, first top panel 302 and second top panel 304 are substantially congruent and have a trapezoidal shape. More specifically, first top panel 302 includes an angled edge 310 extending from an intersection 312 of fold line 306 and free edge 38 toward bottom edge 78 and an angled edge 314 extending from an intersection 316 of fold line 306 and free edge 40 toward bottom edge 78. Similarly, second top panel 304 includes an angled edge 318 extending from an intersection 320 of fold line 308 and free edge 42 toward bottom edge 78 and an angled edge 322 extending from an intersection 324 of fold line 308 and free edge 44 toward bottom edge 78. Angled edge 310, free edge 38, angled edge 30, and bottom edge 78 define cutout 46; angled edge 318, free edge 42, angled edge 32, and bottom edge 78 define cutout 50; angled edge 322, free edge 44, angled edge 34, and bottom edge 78 define cutout 52; and angled edge 314, free edge 40, angled edge 36, and bottom edge 78 define cutout 48.

In addition, first and second top panels 302 and 304 have a depth $D_4$ that is smaller than half of depth $D_1$. In an alternative embodiment, depth $D_4$ is substantially equal to or larger than half of depth $D_1$. In the exemplary embodiment, front panel 20 and rear panel 24 and/or bottom panel 22 and top panels 302 and 304 are equally dimensioned, however, front panel 20 and rear panel 24 and/or bottom panel 22 and top panels 302 and 304 may be other than equally dimensioned. Further, first and second top panels 302 and 304 each have a pair of opposing closure flaps 326 that extend from a first side fold line 328 and a second side fold line 330 of each of first and second top panels 302 and 304. Moreover, first top panel 302 is separated from adjacent reinforcing panels 68 by a first side edge 332 and a second side edge 334. Similarly, second top panel 304 is separated from adjacent reinforcing panels 68 by first side edge 332 and second side edge 334.

Figure 6:
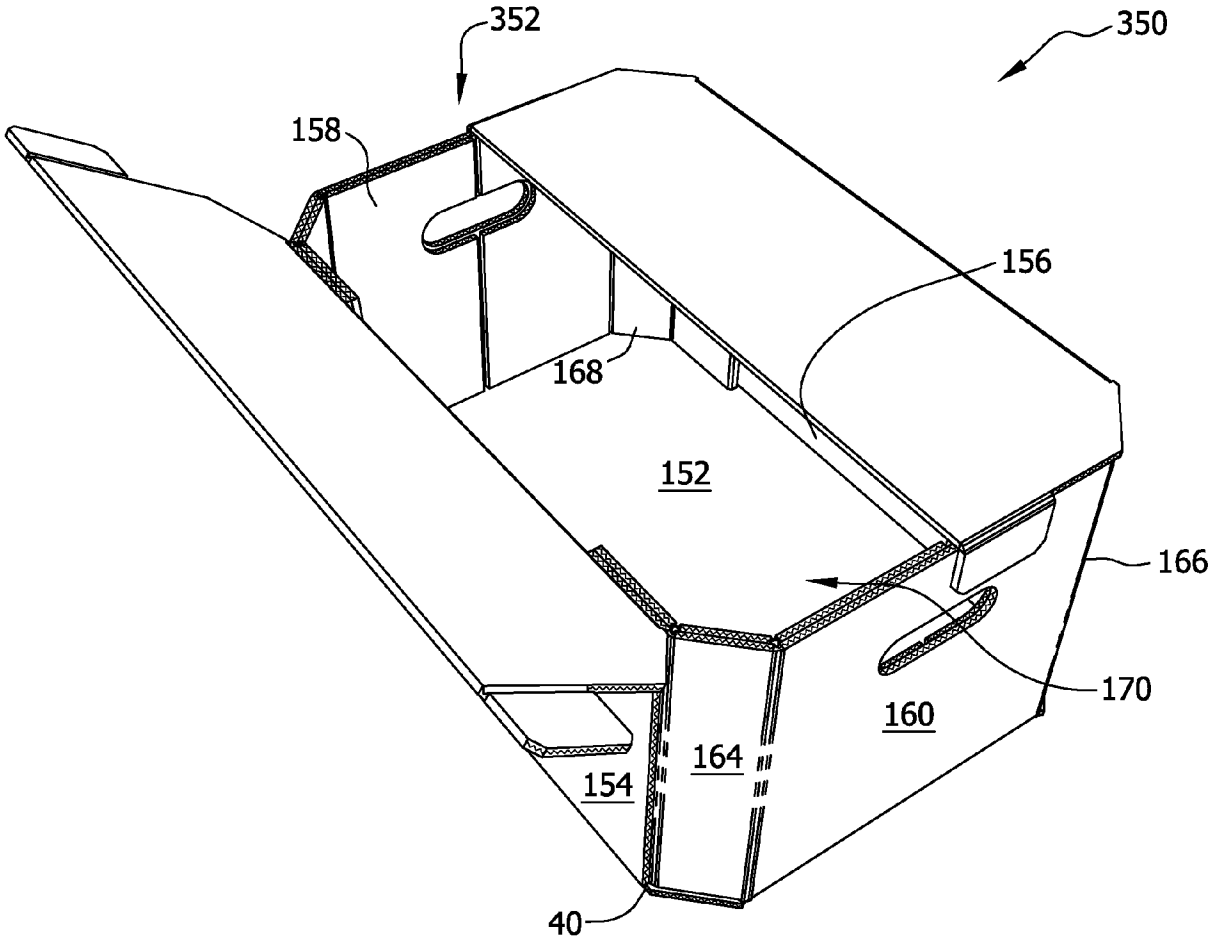
FIG. 6 is a perspective view of a container formed from the blank shown in FIG. 5.

FIG. 6 is a perspective view of container 350 that is formed from blank 300 (shown in FIG. 5). Container 350 is essentially similar to container 150 (shown in FIG. 2) and, as such, similar components are labeled with similar references. Although container 350 is shown as being formed without a product to be contained therein, container 350 may also be formed having a product therein. Further, container 350 may include any suitable number of products of any suitable shape. To construct container 350 from blank 300 a method that is substantially similar to the method for forming container 150 from blank 10 is used. By forming a top wall 352 of container 350, container 350 is considered to be in a "closed configuration" rather than the open configuration of containers 150 and 250.

To close container 350 and form top wall 352, first top panel 302 is rotated about fold line 306 toward cavity 170 such that first top panel 302 is substantially perpendicular to front panel 20 and substantially parallel to bottom panel 22. Further, second top panel 304 is rotated about fold line 308 toward cavity 170 such that second top panel 304 is substantially perpendicular to rear panel 24 and substantially parallel to bottom panel 22. Closure flaps 326 are then rotated toward exterior surface 14 of first and second side panels 54 and 60 and are secured thereto. In the exemplary embodiment, interior surface 12 of each closure flap 326 is adhered to exterior surface 14 of side panels 54 or 60. First and second top panels 302 and 304 form top wall 352 of container 350.

Figure 7:
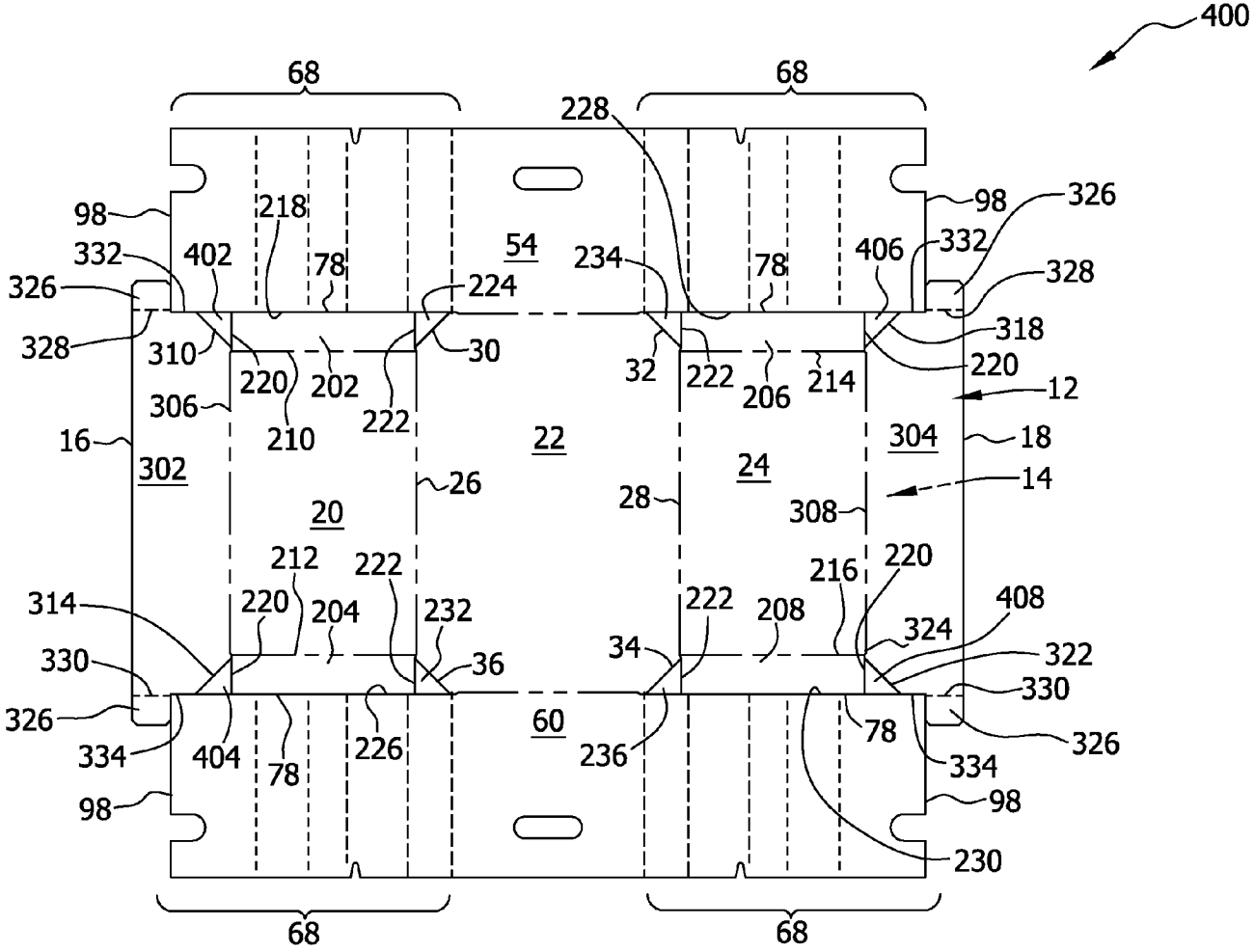
FIG. 7 is a top plan view of a blank of sheet material for constructing a container according to a third alternative embodiment of the present invention.

FIG. 7 is a top plan view of an example embodiment of a blank 400 of sheet material. Blank 400 is essentially similar to blank 200 (shown in FIG. 3) and blank 300 (shown in FIG. 5) and, as such, similar components are labeled with similar references. More specifically, blank 400 is similar to blank 300 and includes outer reinforcing corner panels 202, 204, 206, and 208, as shown and described with respect to FIG. 3. Further, blank 400 includes fold lines 210, 212, 214, and 216 rather than free side edges 38, 40, 42, and 44 (shown in FIG. 5), as shown and described with respect to FIG. 3.

In the exemplary embodiment, in addition to cutouts 224, 232, 234, and 236, blank 400 includes cutouts 402, 404, 406, and 408. More specifically, angled edge 310, top edge 220, and bottom edge 78 define a first cutout 402; angled edge 314, top edge 220, and bottom edge 78 define a second cutout 404; angled edge 318, top edge 220, and bottom edge 78 define a third cutout 406; and angled edge 322, top edge 220, and bottom edge 78 define a fourth cutout 408.

Figure 8:
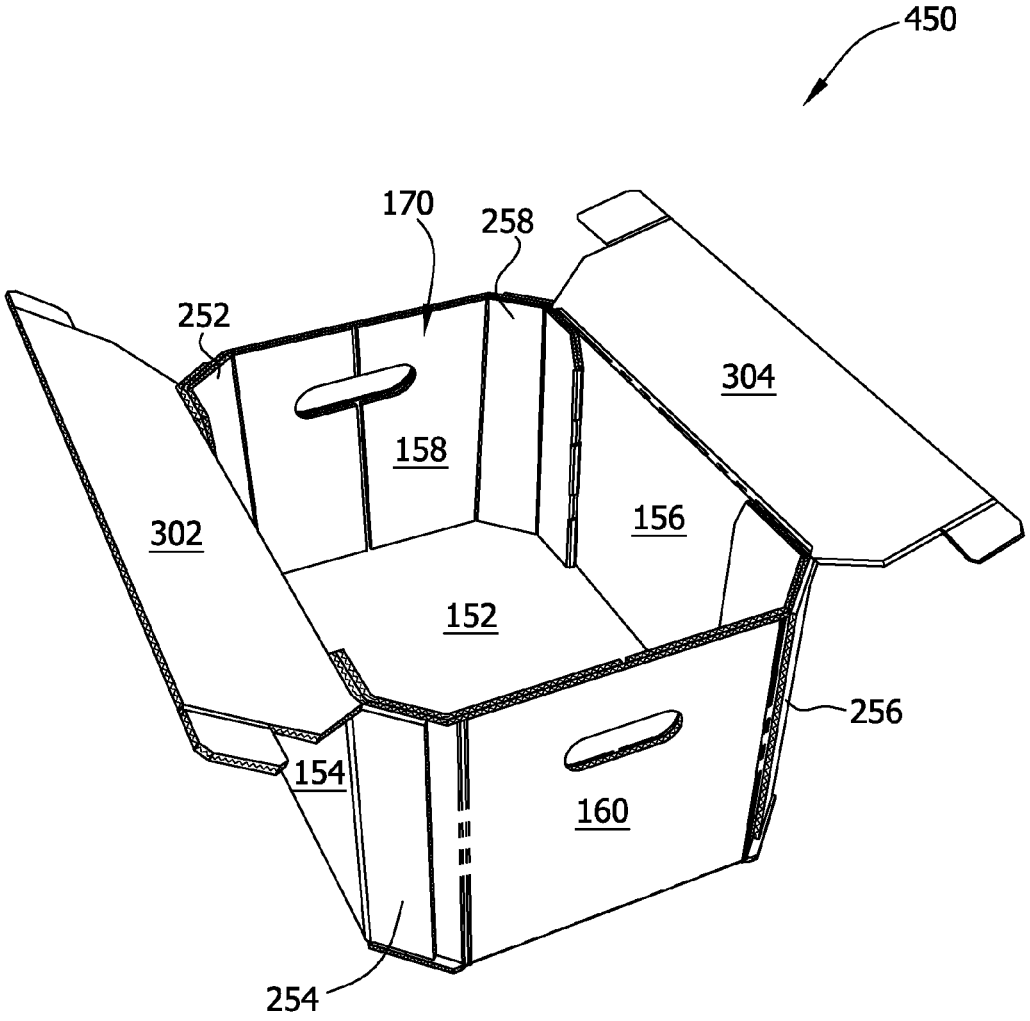
FIG. 8 is a perspective view of a container that is partially formed from the blank shown in FIG. 7.
Figure 9:
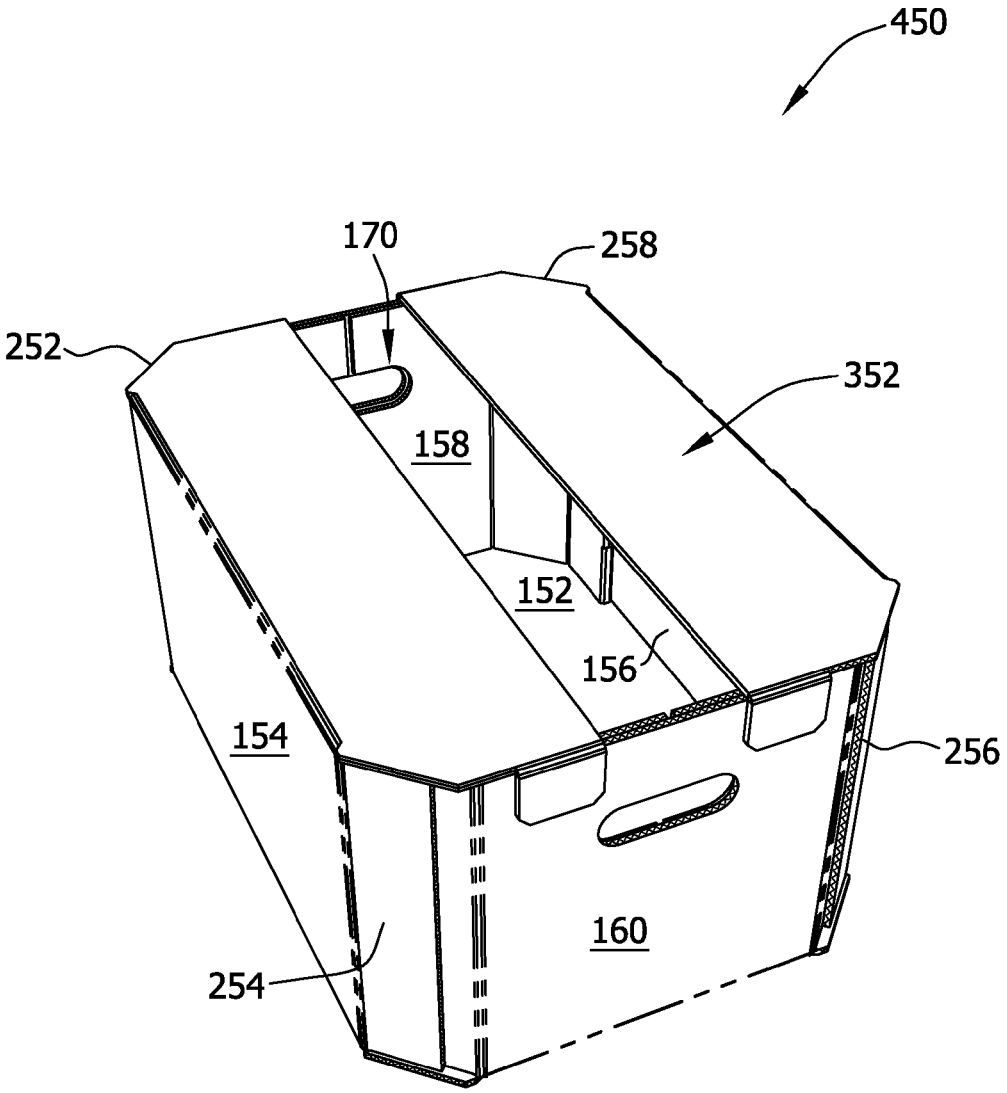
FIG. 9 is a perspective view of a container formed from the blank shown in FIG. 7.

FIG. 8 is a perspective view of a container 450 that is partially formed from blank 400 (shown in FIG. 7). FIG. 9 is a perspective view of container 450 formed from blank 400. Container 450 is essentially similar to container 250 (shown in FIG. 4) and container 350 (shown in FIG. 6) and, as such, similar components are labeled with similar references. Although container 450 is shown as being formed without a product to be contained therein, container 450 may also be formed having a product therein. Further, container 450 may include any suitable number of products of any suitable shape. To construct container 450 from blank 400 a method that is substantially similar to the method for forming container 250 from blank 200 is used. To close container 450, top wall 352 is formed using the method used to construct container 350 from blank 300.

Figure 10:
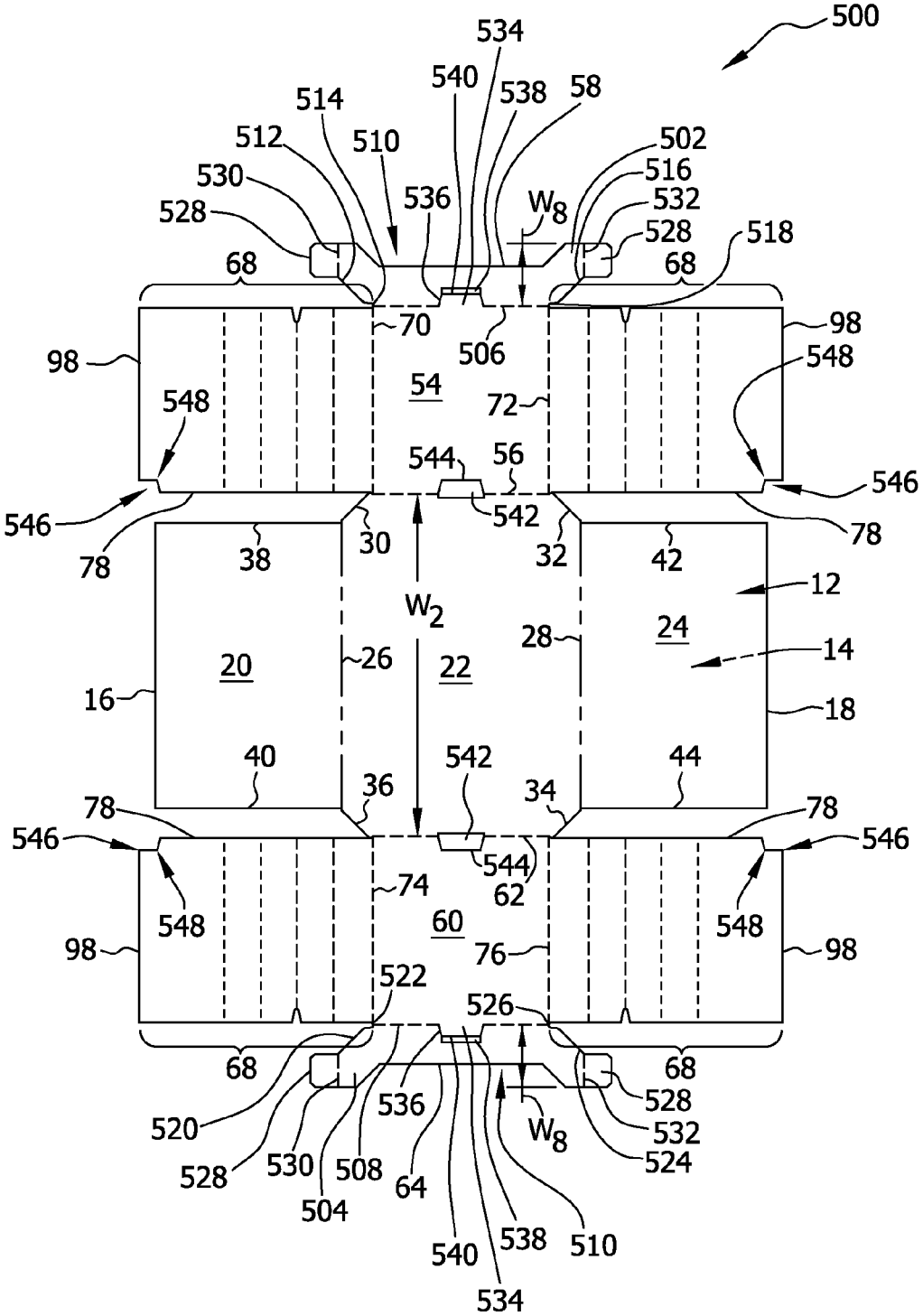
FIG. 10 is a top plan view of a blank of sheet material for constructing a container according to a fourth alternative embodiment of the present invention.

FIG. 10 is a top plan view of an example embodiment of a blank 500 of sheet material. Blank 500 is essentially similar to blank 10 (shown in FIG. 1) and, as such, similar components are labeled with similar references. More specifically, blank 500 includes top panels 502 and 504. Further, blank 500 includes fold lines 506 and 508 as top edges of side panels 54 and 60, respectively, rather than free edge 58 and free edge 64 (shown in FIG. 1) defining top edges of side panels 54 and 60, respectively. Moreover, blank 500 does not include cutouts 66 and 106 (shown in FIG. 1), however, it will be understood that blank 500 may include cutouts 66 and/or 106.

In the exemplary embodiment, blank 500 includes, in series from free edge 58 to free edge 64, a first top panel 502, side panel 54, bottom panel 22, side panel 60, and a second top panel 504 coupled together along preformed, generally parallel, fold lines 506, 56, 62, and 508, respectively. More specifically, first top panel 502 extends between free edge 58 and fold line 506, and second top panel 504 extends from side panel 60 along fold line 508 to free edge 64. When a container 550 (shown in FIG. 11) is formed from blank 500, fold line 506 defines a side edge of top panel 502 and a top edge of side panel 54, and fold line 508 defines a side edge of top panel 504 and a top edge of side panel 60.

In the exemplary embodiment, first top panel 502 and second top panel 504 are substantially congruent and have a trapezoidal shape with a cutout portion 510 defined along free edges 58 and 64, respectively. Cutout portion 510 has any suitable configuration that enables blank 500 and/or container 550 to function as described herein. In one embodiment, cutout portion 510 is configured to enable access to cavity 170 (shown in FIG. 11) of container 550. Alternatively, top panel 502 and/or 504 does not include cutout portion 510. In the exemplary embodiment, first top panel 502 includes an angled edge 512 extending outwardly from an intersection 514 of fold line 506 and fold line 70 and an angled edge 516 extending outwardly from an intersection 518 of fold line 506 and fold line 72. Similarly, second top panel 504 includes an angled edge 520 extending outwardly from an intersection 522 of fold line 508 and fold line 74 and an angled edge 524 extending outwardly from an intersection 526 of fold line 508 and fold line 76. Angled edges 512, 516, 520, and 524 are configured similarly to angled edges 30, 32, 34, and 36, respectively.

In addition, first and second top panels 502 and 504 have a width $W_8$ that is smaller than half of width $W_2$. More specifically, top panels 502 and 504 each have width $W_8$ such that each top panel 502 and 504 forms a top shoulder 552 and 554 (shown in FIG. 11), respectively, when container 550 is formed from blank 500. In an alternative embodiment, width $W_8$ is substantially equal to or larger than half of width $W_2$. Alternatively, width $W_8$ is sized to form a partial top wall. In the exemplary embodiment, top panels 502 and 504 are equally dimensioned, however, top panels 502 and 504 may be other than equally dimensioned. Further, first and second top panels 502 and 504 each have a pair of opposing closure flaps 528 that extend from a front fold line 530 and a rear fold line 532 of each of first and second top panels 502 and 504.

In the exemplary embodiment, fold line 506 and fold line 508 each include a tab 534 defined therein. More specifically, a cut line 536 divides each fold line 506 and 508 to form tab 534. Further, a slot 538 defined in each top panel 502 and 504 defines a top 540 of each tab 534. Alternatively, fold line 506 and/or fold line 508 does not include tab 534 and/or top panel 502 and/or top panel 504 does not include slot 538. Moreover, it will be understood that tab 534 and/or slot 538 may be included in any of the embodiments described herein. For example, tab 534 may extend from free edge 58 and/or free edge 64 in any embodiment including such free edges. Further, tab 534 may extend from leading edge 16, trailing edge 18, fold line 306, and/or fold line 308 of the embodiments described herein.

In the exemplary embodiment, fold line 56 and fold line 62 each include a cutout 542 defined therein. More specifically, a cut line 544 divides each fold line 56 and 62 and defines cutout 542. Cutout 542 may have any suitable configuration that enables blank 500 and/or container 550 to function as described herein. In one embodiment, cutout 542 is sized to receive tab 534 for stacking containers 550 and/or to provide venting for cavity 170. Alternatively, fold line 56 and/or fold line 62 does not include cutout 542. Moreover, it will be understood that cutout 542 may be included in any of the embodiments described herein. For example, cutout 542 may be defined in fold lines 26, 28, 56 and/or 62 of the embodiments described herein.

Further, in the exemplary embodiment, each inner side panel 84 includes a notch 546 defined in a lower free corner 548 thereof. More specifically, notch 546 is defined at corner 548 defined by free edge 98 and bottom edge 78 on each inner side panel 84. Notch 546 is configured to correspond to a portion of cutout 542 such that cutout 542 is not obstructed by inner side panels 84 when container 550 is formed. In an alternatively embodiment, notch 546 may have any suitable configuration that enables blank 500 and/or container 550 to function as described herein. Alternatively, at least one inner side panel 84 does not include notch 546. Moreover, it will be understood that notch 546 may be included in any of the embodiments described herein on any suitable panel.

Figure 11:
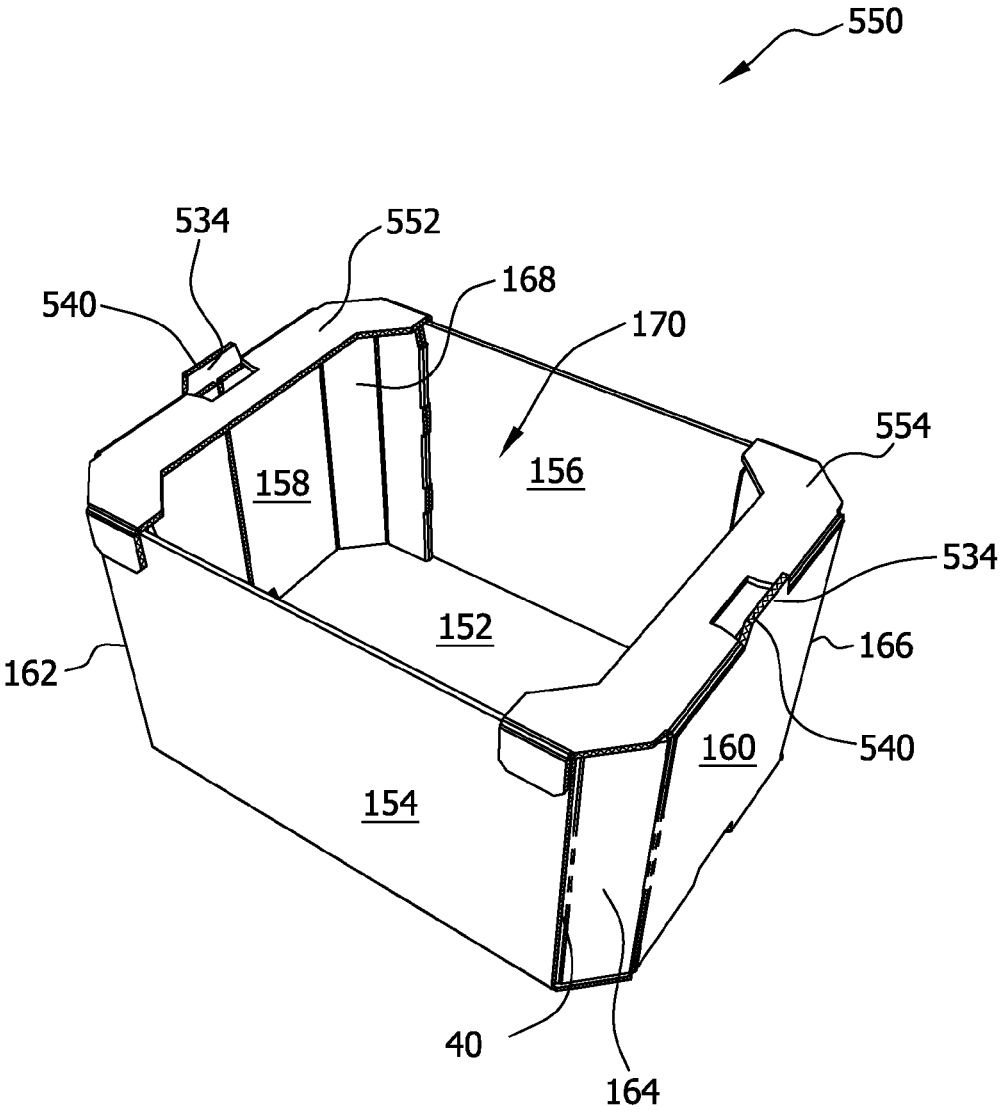
FIG. 11 is a perspective view of a container formed from the blank shown in FIG. 10.

FIG. 11 is a perspective view of container 550 that is formed from blank 500 (shown in FIG. 10). Container 550 is essentially similar to container 150 (shown in FIG. 2) and, as such, similar components are labeled with similar references. Although container 550 is shown as being formed without a product to be contained therein, container 550 may also be formed having a product therein. Further, container 550 may include any suitable number of products of any suitable shape. To construct container 550 from blank 500 a method that is substantially similar to the method for forming container 150 from blank 10 is used. By forming top shoulders 552 and 554 of container 550, container 550 is considered to be in the closed configuration rather than the open configuration of containers 150.

To close container 550 and form top shoulders 552 and 554, first top panel 502 is rotated about fold line 506 toward cavity 170 such that first top panel 502 is substantially perpendicular to first side wall 158 and substantially parallel to bottom wall 152. Further, second top panel 504 is rotated about fold line 508 toward cavity 170 such that second top panel 504 is substantially perpendicular to second side wall 160 and substantially parallel to bottom wall 152. Closure flaps 528 are then rotated toward exterior surface 14 of front panel 20 and rear panel 24 and are secured thereto to form portions of front wall 154 and rear wall 156, respectively. In the exemplary embodiment, interior surface 12 of each closure flap 528 is adhered to exterior surface 14 of front panel 20 or rear panel 24. First and second top panels 502 and 504 form top shoulders 552 and 554 of container 550.

Figure 12:
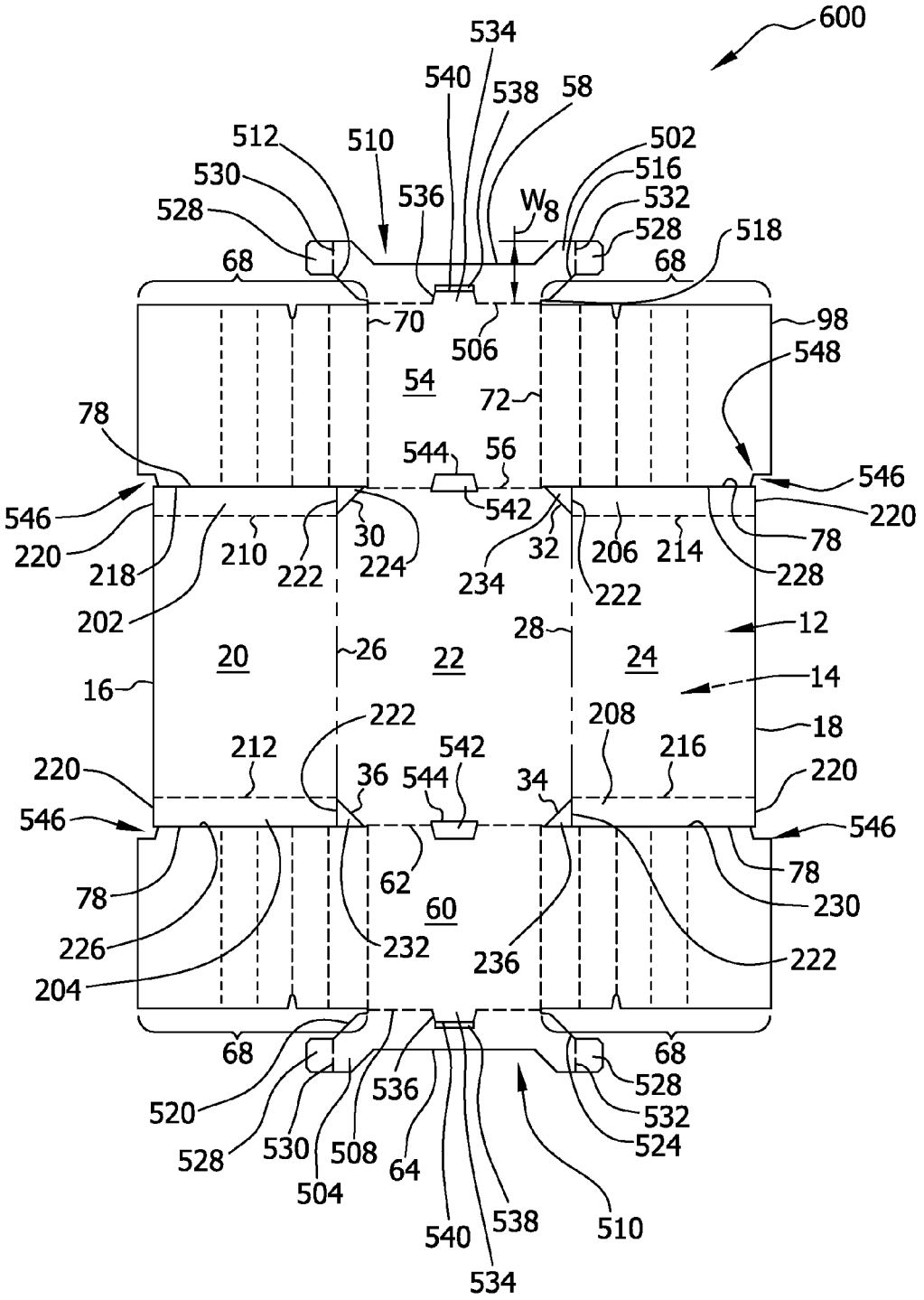
FIG. 12 is a top plan view of a blank of sheet material for constructing a container according to a fifth alternative embodiment of the present invention.

FIG. 12 is a top plan view of an example embodiment of a blank 600 of sheet material. Blank 600 is essentially similar to blank 200 (shown in FIG. 3) and blank 500 (shown in FIG. 10) and, as such, similar components are labeled with similar references. More specifically, blank 600 is similar to blank 500 and includes outer reinforcing corner panels 202, 204, 206, and 208, as shown and described with respect to FIG. 3. Further, blank 600 includes fold lines 210, 212, 214, and 216 rather than free side edges 38, 40, 42, and 44 (shown in FIG. 10), as shown and described with respect to FIG. 3.

Figure 13:
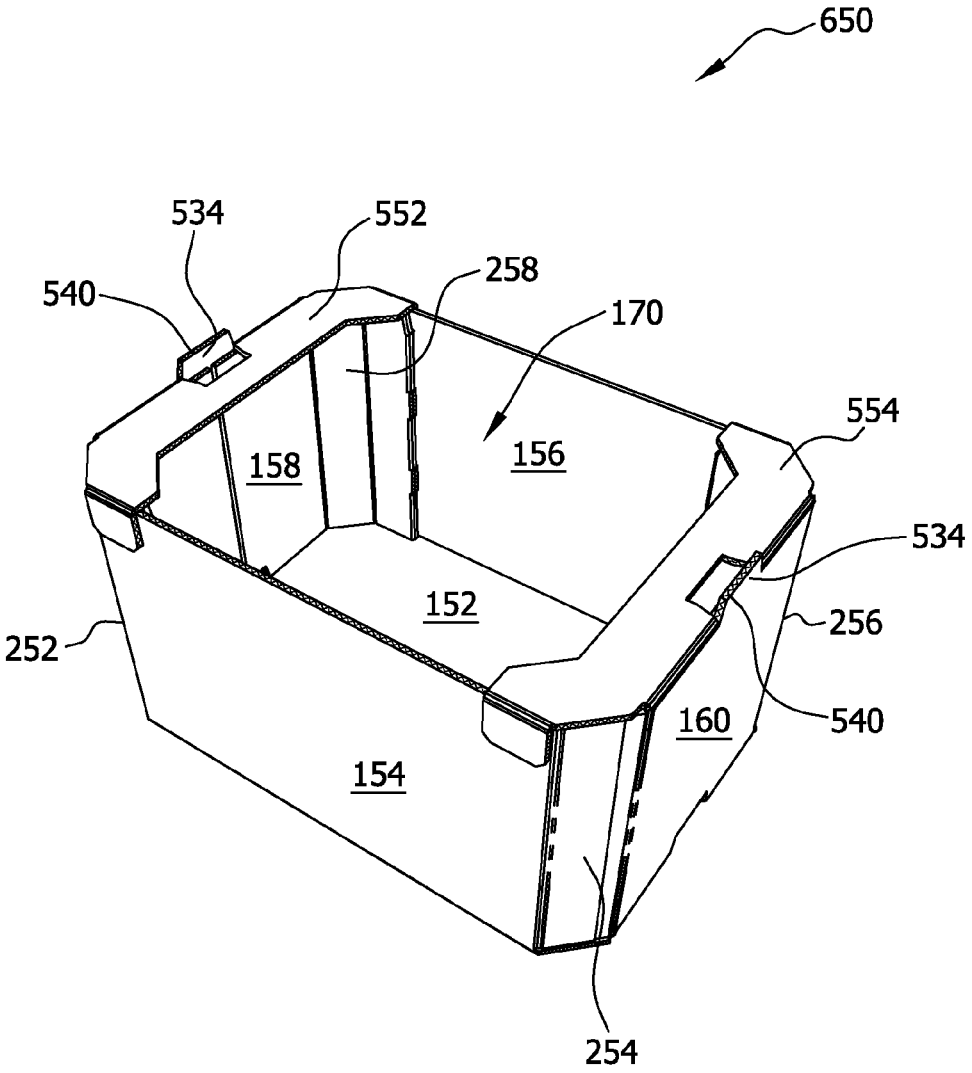
FIG. 13 is a perspective view of a container formed from the blank shown in FIG. 12.

FIG. 13 is a perspective view of a container 650 that is partially formed from blank 600 (shown in FIG. 12). Container 650 is essentially similar to container 250 (shown in FIG. 4) and container 550 (shown in FIG. 11) and, as such, similar components are labeled with similar references. Although container 650 is shown as being formed without a product to be contained therein, container 650 may also be formed having a product therein. Further, container 650 may include any suitable number of products of any suitable shape. To construct container 650 from blank 600 a method that is substantially similar to the method for forming container 250 from blank 200 is used. To close container 650, top shoulders 552 and 554 are formed using the method used to construct container 550 from blank 500.

Figure 14:
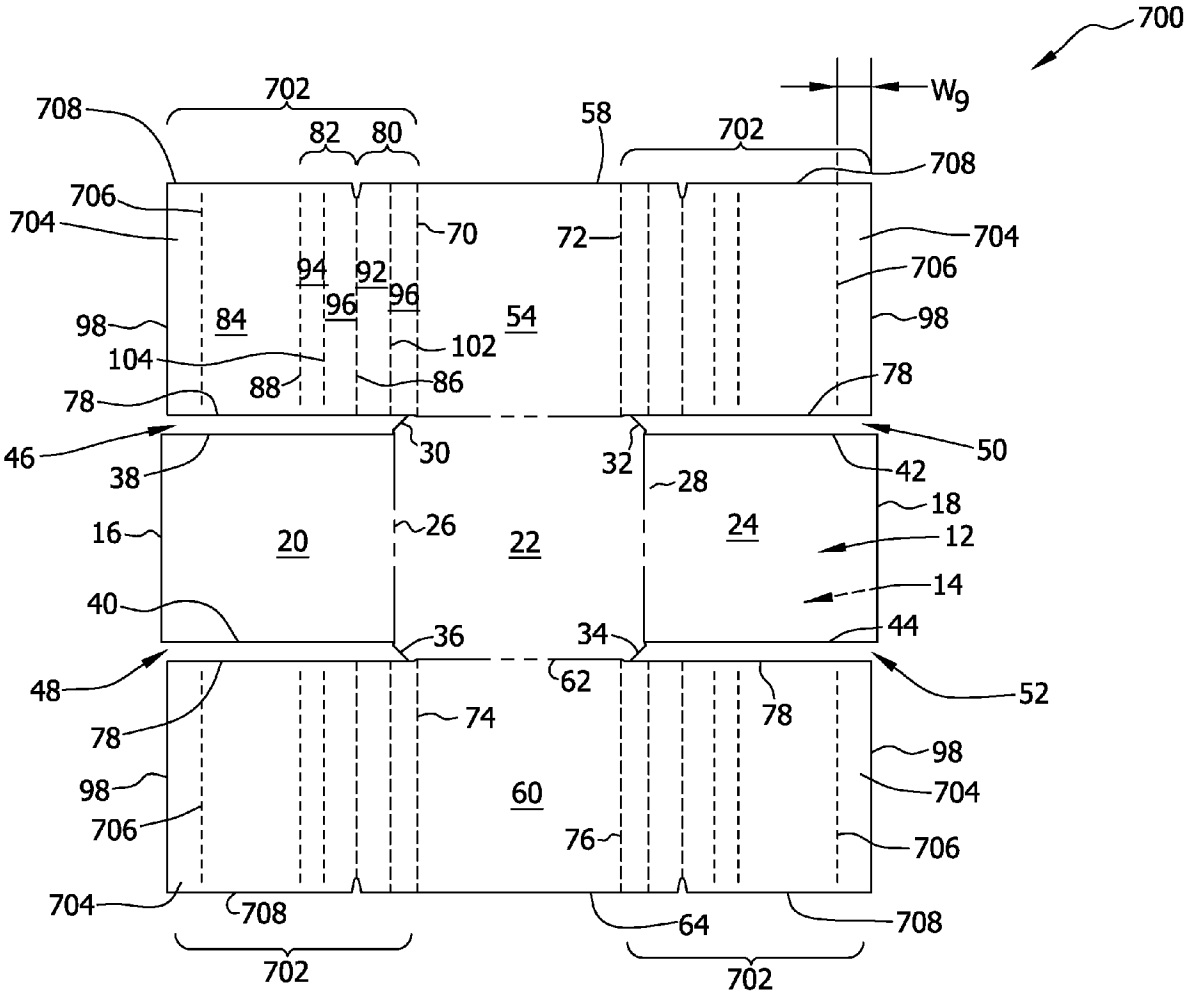
FIG. 14 is a top plan view of a blank of sheet material for constructing a container according to a sixth alternative embodiment of the present invention.
Figure 15:
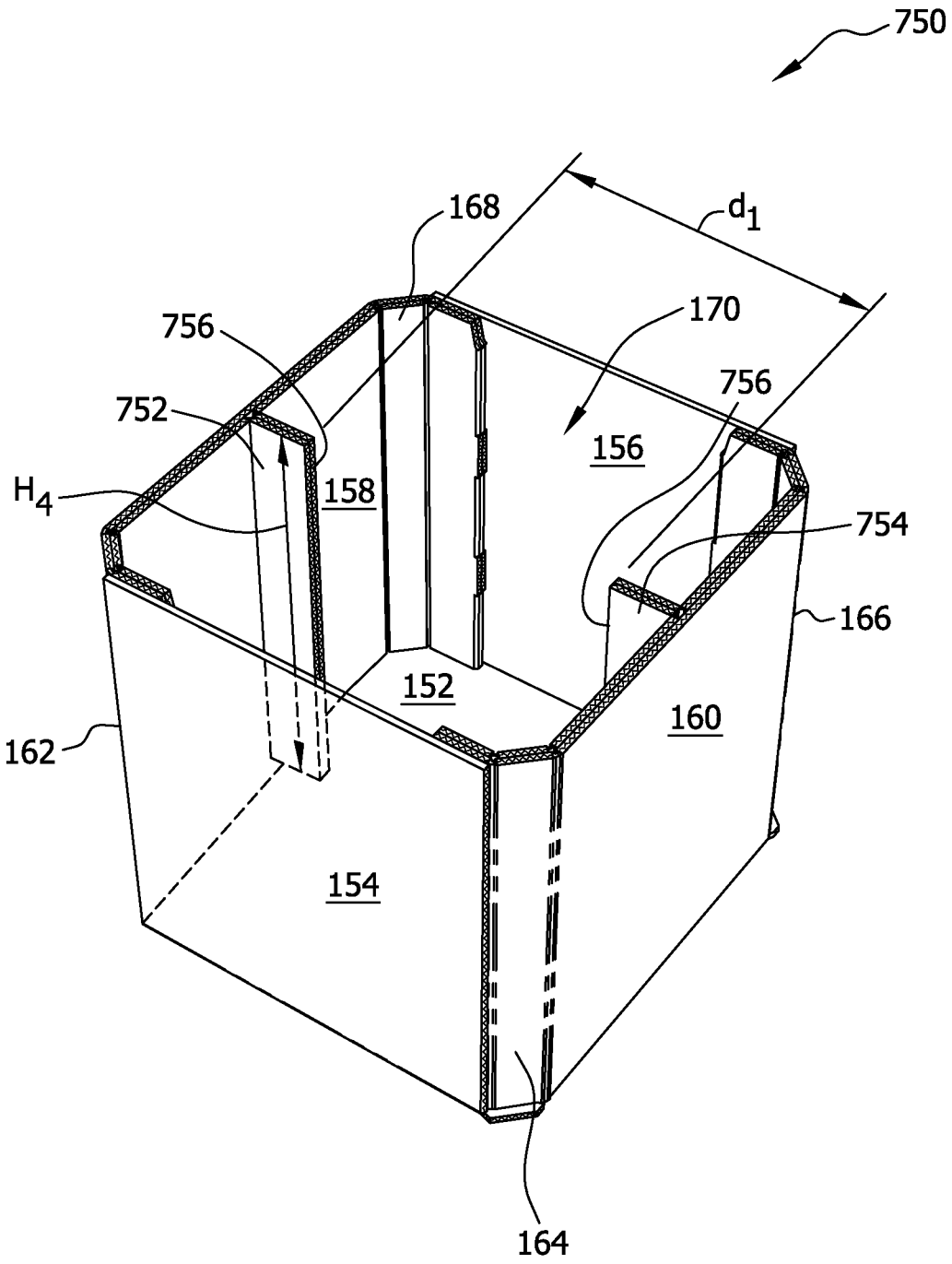
FIG. 15 is a perspective view of a container formed from the blank shown in FIG. 14.

FIG. 14 is a top plan view of an example embodiment of a blank 700 of sheet material for forming a container 750 (shown in FIG. 15). Blank 700 is essentially similar to blank 10 (shown in FIG. 1) and, as such, similar components are labeled with similar references. More specifically, blank 700 includes reinforcing panels 702 that each include a support panel 704. Moreover, blank 700 does not include cutouts 66 and 106, however, it will be understood that blank 700 may include cutouts 66 and/or 106 on side panels 54 and/or 60, front panel 20, and/or rear panel 24. Further, in an alternative embodiment, blank 700 includes top panels 302 and 304, as shown as described with respect to FIG. 5, and/or top panels 502 and 504, as shown and described with respect to FIG. 10.

In the exemplary embodiment, blank 700 includes a reinforcing panel 702 that extends from each side edge of side panels 54 and 60. Reinforcing panel 702 is also referred to herein as a reinforcing panel assembly that includes a plurality of panels as described in more detail herein. More specifically, a reinforcing panel 702 extends from each of fold lines 70, 72, 74, and 76. Further, each reinforcing panel 702 includes free bottom edge 78. Each free bottom edge 78 at least partially defines cutouts 46, 48, 50, and 52. Moreover, each reinforcing panel 702 is substantially similar and includes, in series from a fold line 70, 72, 74, or 76 to free edge 98, outer reinforcing wall 80, inner reinforcing wall 82, inner side panel 84, and support panel 704, connected along substantially parallel fold lines 86, 88, and 706. Fold line 706 defines a side edge of inner side panel 84 and a side edge of support panel 704, and free edge 98 defines a side edge of support panel 704.

Outer reinforcing wall 80 includes corner panel 90 and first reinforcing end panel 92, and inner reinforcing wall 82 includes inner reinforcing corner panel 94 and second reinforcing end panel 96. More specifically, support panel 704 extends between free edge 98 and fold line 706, inner side panel 84 extends from support panel 704 along fold line 706, inner reinforcing corner panel 94 extends from inner side panel 84 along fold line 88, second reinforcing end panel 96 extends from inner reinforcing corner panel 94 along fold line 104, first reinforcing end panel 92 extends from second reinforcing end panel 96 along fold line 86, and corner panel 90 extends from first reinforcing end panel 92 along fold line 102 to a respective fold line 70, 72, 74, or 76.

In the exemplary embodiment, each support panel 704 is substantially rectangularly shaped, although it will be understood that support panel 704 may have any suitable shape and/or configuration that enables blank 700 and/or container 750 to function as described in herein. Further, in the exemplary embodiment, support panel 704 has a width $W_9$ that is substantially constant from a top edge 708 of reinforcing panel 702 to bottom edge 78. Alternatively, width $W_9$ may be other than constant between top edge 708 and bottom edge 78. In the exemplary embodiment, width $W_9$ is less than half of width $W_2$ of bottom panel 22. Alternatively, width $W_9$ is equal to or greater than width $W_2$ such that support walls 752 and 754 (shown in FIG. 15) formed from support panels 704 divide container 750 and provide support to container 750. In the exemplary embodiment, each support panel 704 includes the same width $W_9$. In an alternative embodiment, at least one support panel 704 includes a width that is different than width $W_9$ of other support panels 704.

FIG. 15 is a perspective view of container 750 that is formed from blank 700 (shown in FIG. 14). Container 750 is essentially similar to container 150 (shown in FIG. 2) and, as such, similar components are labeled with similar references. Although container 750 is shown as being formed without a product to be contained therein, container 750 may also be formed having a product therein. Further, container 750 may include any suitable number of products of any suitable shape. To construct container 750 from blank 700 a method that is substantially similar to the method for forming container 150 from blank 10 is used except support walls 752 and 754 are formed. In the exemplary embodiment, container 750 has an open configuration, however, it will be understood that container 750 may include a top wall and be in a closed configuration.

To construct container 750 from blank 700, each inner side panel 84 and respective inner reinforcing wall 82 are folded about fold line 86 such that inner reinforcing wall 82 and outer reinforcing wall 80 are in an at least partially overlying relationship, and such that inner side panel 84 is in an at least partially overlying relationship with at least a portion of first or second side panel 54 or 60. More specifically, blank 700 is folded along fold line 86 such that corner panel 90 and inner reinforcing corner panel 94 are substantially aligned in an at least partially overlying relationship, first and second reinforcing end panels 92 and 96 are substantially aligned in an at least partially overlying relationship, and inner side panel 84 and at least a portion of first or second side panel 54 or 60 are substantially aligned in an at least partially overlying relationship. As blank 700 is being folded about fold line 86, support panels 704 are folded about fold lines 706 such that exterior surface 14 of support panel 704 is rotated towards exterior surface 14 of inner side panel 84. Alternatively, support panels 704 are rotated about fold lines 706 before or after blank 700 is folded about fold line 86. In the exemplary embodiment, after blank 700 is folded about fold lines 86 and 706, one support panel 704 is aligned in at least partially overlying relationship within another support panel 704 such that interior surfaces 12 of support panels 704 are adjacent to each other.

In the exemplary embodiment, inner side panel 84, a respective side panel 54 or 60, reinforcing end panels 92 and 96, corner panels 90 and 94 and/or support panels 704 are secured in the above-described relationships. For example, inner side panel 84, a respective side panel 54 or 60, reinforcing end panels 92 and 96, corner panels 90 and 94 and/or support panels 704 are held against the product to be contained by a force on exterior surface 14 as container 750 continues to be erected. In another example, inner side panel 84 may be adhered to a respective side panel 54 or 60, reinforcing end panels 92 and 96 may be adhered together, corner panels 90 and 94 may be adhered together, and/or support panels 704 may be adhered together. Reinforcing walls 80 and 82, reinforcing end panels 92 and 96 are rotated about fold lines 70, 72, 74, 76, 88, 102, and/or 104 as described with respect to container 150. Further, the remainder of container 750 is constructed similarly to container 150.

When container 150 is formed, support panels 704 form a first support wall 752 and a second support wall 754 extending into cavity 170. More specifically, first support wall 752 extends from first side wall 158, and second support wall 754 extends from second side wall 160. In the exemplary embodiment, support panels 704 forming each support wall 752 and 754 are in contact with each other along a height $H_4$ of each support wall 752 and 754. Alternatively, a gap may be defined between support panels 704 forming support wall 752 and/or 754 along at least a portion of height $H_4$. Further, in the exemplary embodiment, support wall 752 is separated from support wall 754 by a distance $d_1$. Alternatively, support walls 752 and 754 are in contact along at least a portion of an inner edge 756 of each support wall 752 and 754. In an alternative embodiment, at least a portion of support wall 752 overlaps support wall 754.

Figure 16:
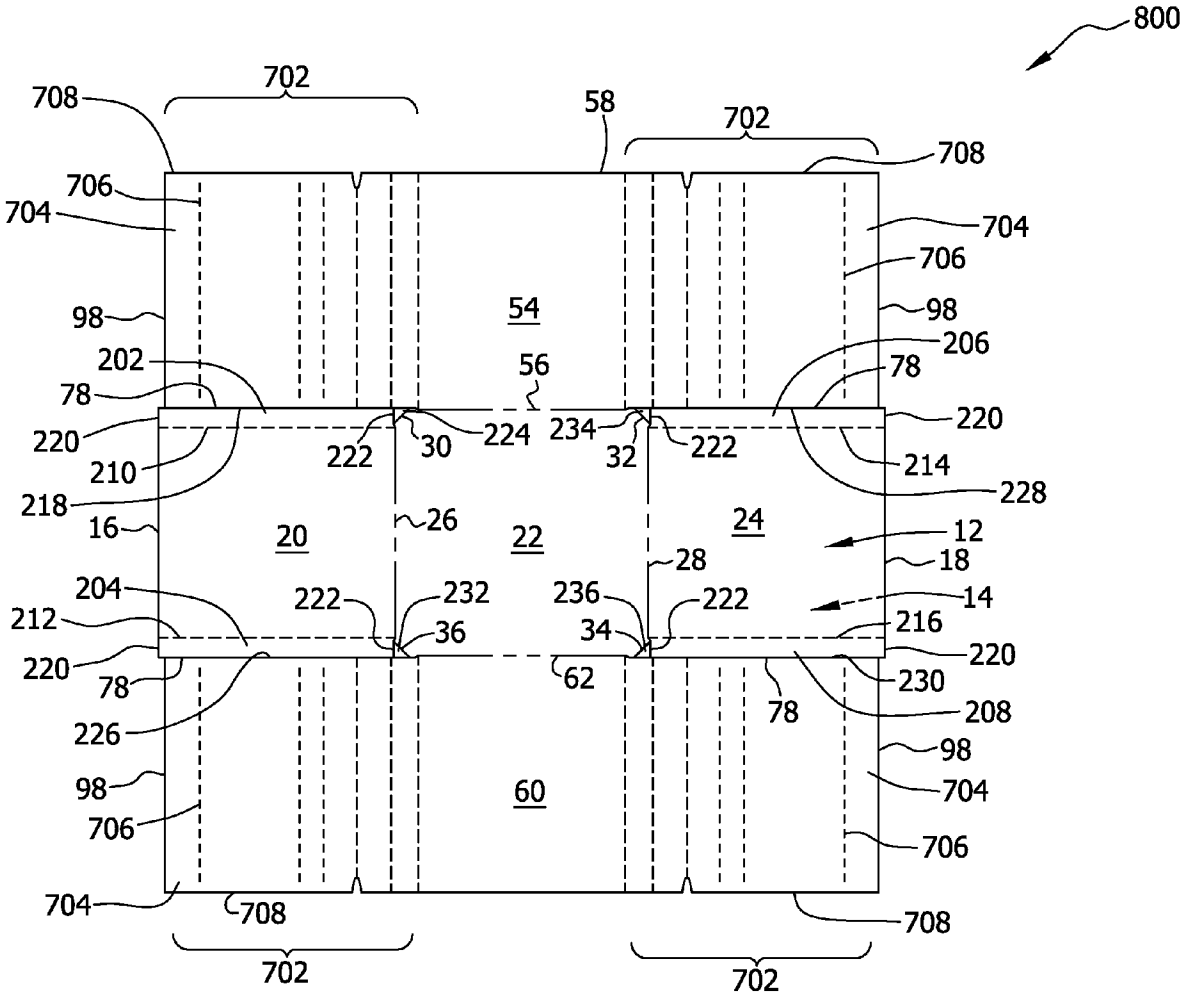
FIG. 16 is a top plan view of a blank of sheet material for constructing a container according to a seventh alternative embodiment of the present invention.

FIG. 16 is a top plan view of an example embodiment of a blank 800 of sheet material. Blank 800 is essentially similar to blank 200 (shown in FIG. 3) and blank 700 (shown in FIG. 14) and, as such, similar components are labeled with similar references. More specifically, blank 800 is similar to blank 700 and includes outer reinforcing corner panels 202, 204, 206, and 208, as shown and described with respect to FIG. 3. Further, blank 700 includes fold lines 210, 212, 214, and 216 rather than free side edges 38, 40, 42, and 44 (shown in FIG. 14), as shown and described with respect to FIG. 3.

In the exemplary embodiment, blank 800 does not include cutouts 66 and 106 (shown in FIG. 3), however, it will be understood that blank 800 may include cutouts 66 and/or 106 on side panels 54 and/or 60, front panel 20, and/or rear panel 24. Further, in an alternative embodiment, blank 800 includes top panels 302 and 304, as shown as described with respect to FIG. 5, and/or top panels 502 and 504, as shown and described with respect to FIG. 10.

Figure 17:
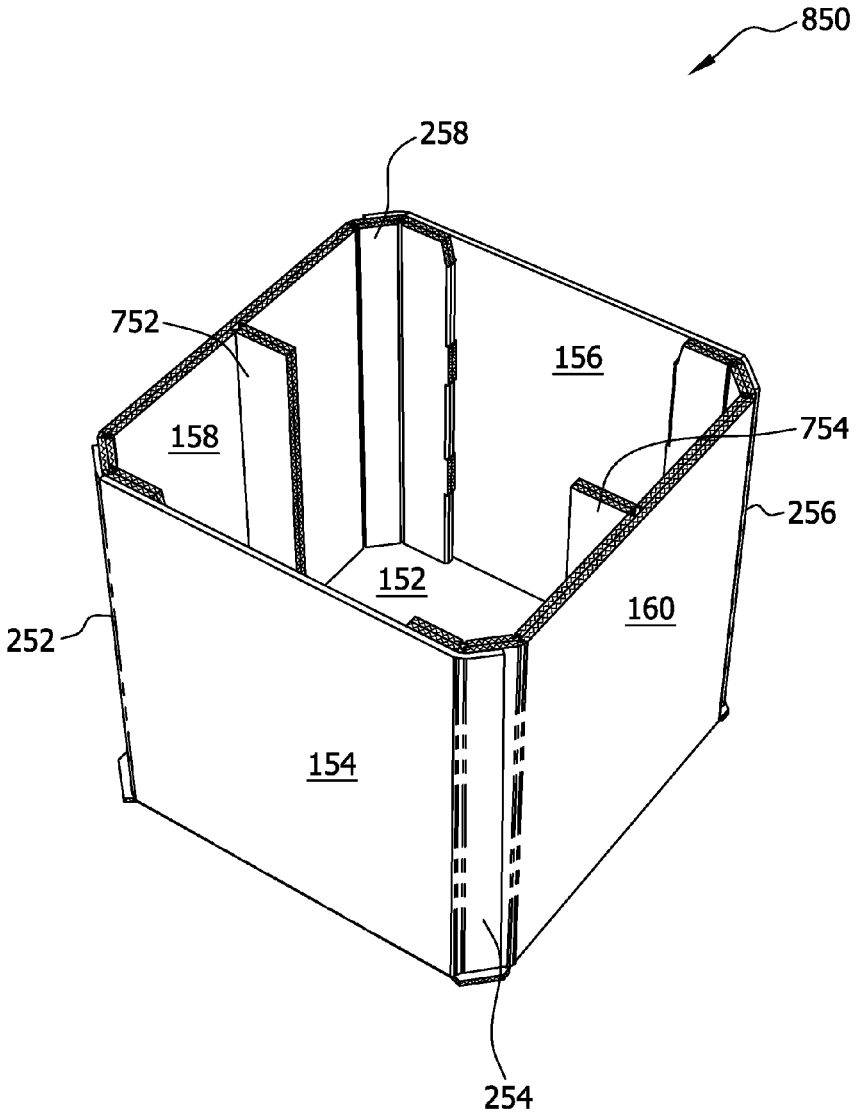
FIG. 17 is a perspective view of a container formed from the blank shown in FIG. 16.

FIG. 17 is a perspective view of a container 850 that is partially formed from blank 800 (shown in FIG. 16). Container 850 is essentially similar to container 250 (shown in FIG. 4) and container 750 (shown in FIG. 15) and, as such, similar components are labeled with similar references. Although container 850 is shown as being formed without a product to be contained therein, container 850 may also be formed having a product therein. Further, container 850 may include any suitable number of products of any suitable shape. To construct container 850 from blank 800 a method that is substantially similar to the methods for forming container 250 and container 750 are used.

Figure 18:
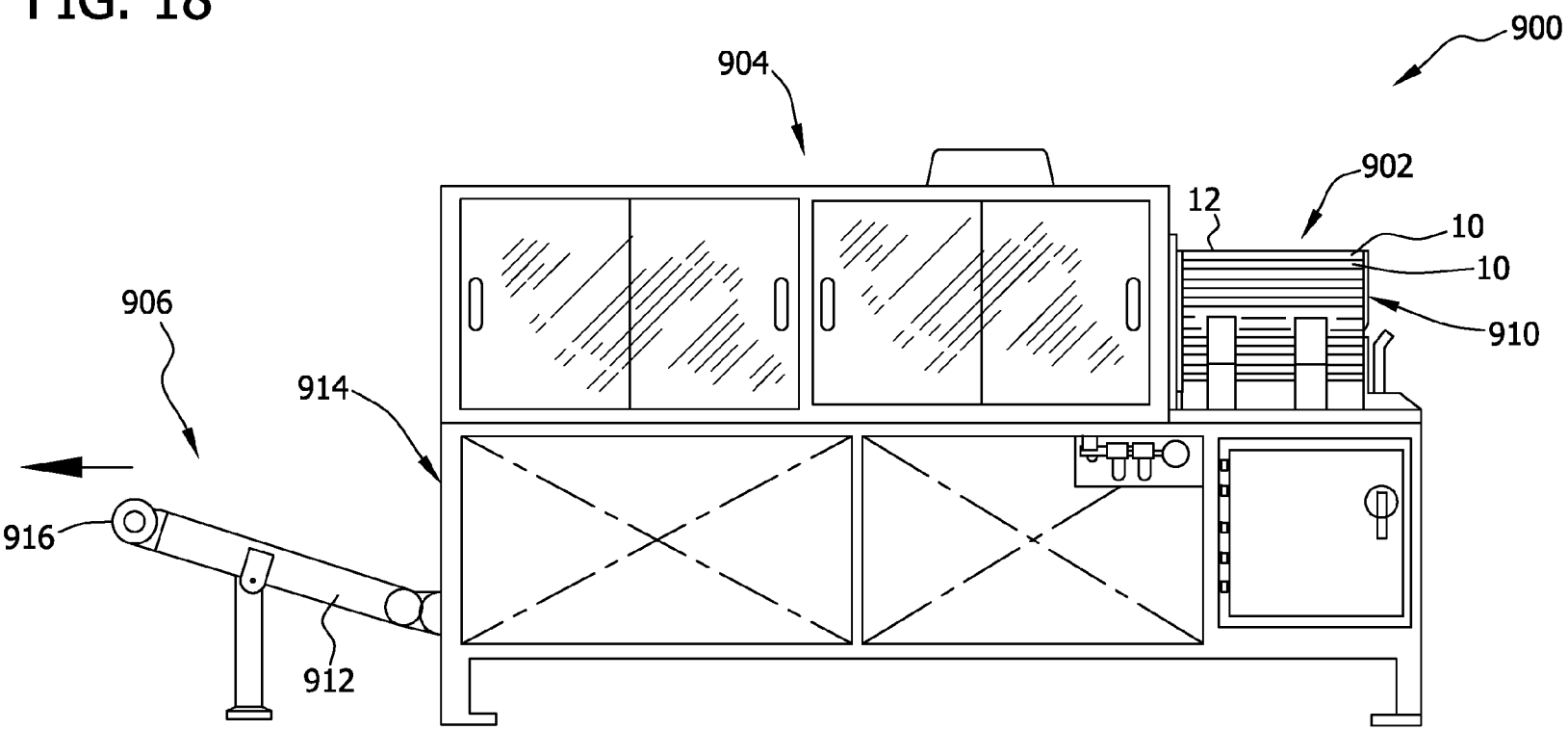
FIG. 18 is a side view of a machine for forming a container from a blank.
Figure 19:
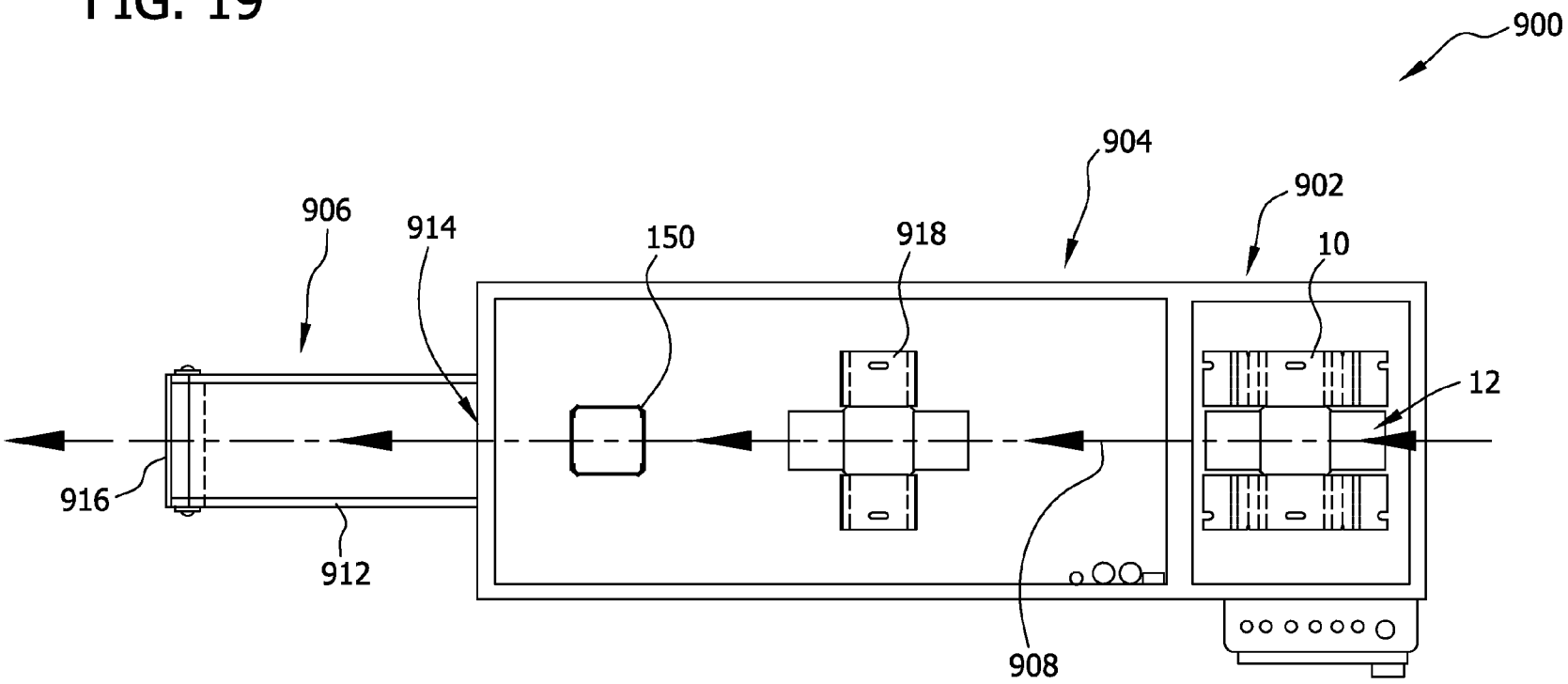
FIG. 19 is a top view of the machine shown in FIG. 18.

FIG. 18 is a side view of a machine 900 for forming a container from a blank. FIG. 19 is a top view of machine 900. Blank 10 and container 150 are illustrated as being formed using machine 900; however, it will be understood that any of the above-described blanks can be formed into a respective container using machine 900.

In the exemplary embodiment, machine 900 includes a hopper station 902, a forming station 904, and an ejection station 906. More specifically, hopper station 902, forming station 904, and ejection station 906 are connected by a transport system 908, such as any suitable conveyor(s) and/or motorize device(s) configured to move blank 10 and/or container 150 through machine 900. In the exemplary embodiment, hopper station 902 is configured to store a stack 910 of blanks 10 in a horizontal orientation. More specifically, blanks 10 are stored with interior surface 12 facing upward.

Forming station 904 includes of any suitable number and/or configuration of components, such as plows, arms, actuators, and/or other devices for forming container 150 from blank 10. In the exemplary embodiment, components of forming station 904 are in communication with a control system. The control system is configured to control and/or monitor components of forming station 904 to form container 150 from blank 10. In the exemplary embodiment, the control system includes computer-readable instructions for performing the methods described herein.

In one embodiment, an operator can select which blank 10, 200, 300, 400, 500, 600, 700, and/or 800 is being manipulated by machine 900 using the control system and the control system performs the corresponding method using the components of forming station 904.

In the exemplary embodiment, ejection station 906 is configured to eject container 150 from forming station 904. More specifically, in the exemplary embodiment, ejection station 906 includes an exit conveyor 912 that is oriented on an incline from an exit 914 of forming station 904 to an end 916 of exit conveyor 912. Alternatively, exit conveyor 912 is at any suitable orientation that enables machine 900 to function as described herein. In the exemplary embodiment, exit conveyor 912 is part of transport system 908.

During operation of machine 900 to form container 150 from blank 10, stack 912 of blanks 10 is placed within hopper station 902. Transport system 908 removes one blank 10 from stack 910 and transfers blank 10 to forming station 904. Transport system 908 transfers blank 10 through the components of forming station 904. The components of forming station 904 perform the method for forming container 150 from blank 10, as described in more detail above. Within forming station 904, blank 10 is folded into a partially constructed container 918. Partially constructed container 918 is formed into container 150 within forming station 904, and a subsequent blank 10 is transferred from hopper station 902 into forming station 904. As such, containers 150 are formed continuously by machine 900. After container 150 is formed in forming station 904, transport system 908 transfers container 150 to ejection station 906 for ejection from machine 900.

In one aspect, a blank of sheet material for forming a container is provided. The blank includes a series of three generally rectangular panels constructed along a plurality of substantially parallel fold lines. The panels include a front panel, a bottom panel, and a rear panel. A first lateral panel extends from each opposing side edge of the front panel and rear panel, and a side panel extends from each opposing side edge of the bottom panel. A plurality of reinforcing panels extend from opposing side edges of the side panels.

In the example embodiment, a blank of sheet material for forming a container is provided. The blank includes a series of three generally rectangular panels connected along a plurality of substantially parallel fold lines wherein the panels include a front panel, a bottom panel, and a rear panel, a first lateral panel extending from each opposing side edge of each of the front panel and the rear panel, a side panel extending from each opposing side edge of the bottom panel, and a plurality of reinforcing panels extending from opposing side edges of the side panel. The plurality of reinforcing panels extending from each edge of the side panels further includes an inner side panel, corner panel and inner reinforcing corner panel, and first and second reinforcing end panels.

A container is formed from the blank of sheet material. In one embodiment, the container includes a bottom wall, a pair of end walls, a pair of side walls, at least one corner wall, and at least one reinforcing wall, wherein the walls are interconnected along a plurality of fold lines. The at least one corner wall extends between an adjacent end wall and side wall. Each reinforcing wall includes at least one side reinforcing panel coupled in an at least partially overlying relationship to at least one side wall of said pair of side walls, a reinforcing corner panel coupled in an at least partially overlying relationship to said at least one corner wall, and a reinforcing end panel coupled in an at least partially overlying relationship with at least one end wall of the pair of end walls.

In another embodiment, the container includes a front wall, a rear wall, a pair of opposing side walls, a bottom wall, and at least one outer corner wall that extends between an adjacent front or rear wall and side wall, and a set of reinforcing panels, wherein the set of reinforcing panels includes an inner side reinforcing panel, a first and second inner reinforcing corner panel, and a first and second inner reinforcing end panel. The set of reinforcing panels is folded along a fold line such that the inner side reinforcing panel is in an at least partially overlying relationship with at least one side wall, the first inner reinforcing corner panel is in an at least partially overlying relationship with the second inner reinforcing corner panel, and the first inner reinforcing end panel is in an at least partially overlying relationship with the second inner reinforcing end panel. The front and rear panels are in an at least partially overlying relationship with a respective second inner reinforcing end panel, and each of the outer corner walls is in an at least partially overlying relationship with a respective second inner reinforcing panel.

In still another aspect, a method of forming a container from a blank of sheet material is provided. The blank includes a front panel, a bottom panel, and a rear panel in series connected along a plurality of substantially parallel fold lines. The blank further includes a lateral panel extending from opposing side edges of the front and rear panels, a side panel extending from opposing side edges of the bottom panel, and a set of reinforcing panels extending from opposing side edges of each side panel. Each set of reinforcing panels includes a reinforcing side panel, corner panel and inner reinforcing corner panel, and first and second reinforcing end panels. The method includes rotating the reinforcing side panels, the inner reinforcing corner panels and the second reinforcing end panels about a fold line such that the reinforcing side panels are in an at least partially overlying relationship with at least one side panel, the corner panels are in an at least partially overlying relationship with the inner reinforcing corner panels to form a reinforcing corner wall, and the first reinforcing end panels are in an at least partially overlying relationship with the second reinforcing end panels to form a reinforcing end wall. The method also includes rotating the side panels about respective fold lines toward the bottom panel to form opposing side walls and rotating the reinforcing corner wall and the reinforcing end wall about respective fold lines toward the bottom panel. Further, the method includes rotating the front and rear panels about respective fold lines toward the bottom panel to form opposing front and rear walls and rotating the lateral panels along respective fold lines toward respective corner reinforcing walls such that each lateral panel is in an at least partially overlying relationship with a respective reinforcing corner wall.

The above-described blanks and containers provide a reinforcing polygonal container. More specifically, the embodiments described herein provide an octagonal container having reinforced corner walls, side walls, and end walls for storing and/or transporting a product therein. Further, the embodiments described herein provide a polygonal container having a top wall. More specifically, the top wall may be formed from top panels emanating from the side walls of the container or the end walls of the container. The top wall may be a full top wall covering substantially the entire cavity of the container or may be a partial top wall, such as top shoulders, that allows access to the cavity of the container when the top wall is formed. Moreover, the embodiments described herein include an outer reinforcing panel to provide further support to the containers. Embodiments not including the outer reinforcing panel may be preferable when printing is to be applied to the exterior of the container. Additionally, the blanks and containers described herein may include a support wall for additional support of the container when, for example, the containers are stacked. The support wall may also act as a partition or divider for the cavity of the container.

Exemplary embodiments of a container formed to contain a product therein and blanks for making the same are described above in detail. The blanks and the container are not limited to the specific embodiments described herein, but rather, components of the blanks and/or the container may be utilized independently and separately from other components described herein. For example, the blanks may also be used in combination with other types of product, and is not limited to practice with only the cylindrical products, as described herein. Rather, the exemplary embodiment can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a polygonal container, said blank comprising:
- a bottom panel;
- two opposing side panels, each side panel extending from a side edge of the bottom panel;
- two opposing end panels, each end panel extending from an end edge of the bottom panel; and
- a reinforcing panel assembly extending from a first side edge of a first side panel of the two side panels, the reinforcing panel assembly comprising:
- a corner panel extending from the first side edge of the first side panel, the corner panel having a first width and a first height;
- a first reinforcing end panel extending from a side edge of the corner panel;
- a second reinforcing end panel extending from a side edge of the first reinforcing end panel;
- an inner reinforcing corner panel extending from a side edge of the second reinforcing end panel, the inner reinforcing corner panel having a second width substantially equal to the first width, the inner reinforcing corner panel having a second height substantially equal to the first height; and
- an inner side panel extending from a side edge of the inner reinforcing corner panel.

2. A blank in accordance with claim 1, wherein the corner panel and the inner reinforcing corner panel are configured to form a corner wall extending from an end edge of a side wall to an end edge of an end wall when the container is formed.

3. A blank in accordance with claim 1 further comprising a plurality of reinforcing panel assemblies, wherein one reinforcing panel assembly of the plurality of reinforcing panel assemblies extends from opposing side edges of each side panel.

4. A blank in accordance with claim 1, wherein the two end panels further comprise:
- a front panel extending from a first end edge of the bottom panel; and
- a rear panel extending from a second end edge of the bottom panel, the second end edge opposite the first end edge.

5. A blank in accordance with claim 1, wherein each end panel comprises two free side edges.

6. A blank in accordance with claim 1 further comprising:
- a first outer reinforcing corner panel extending from a first side edge of a first end panel of the two end panels;
- a second outer reinforcing corner panel extending from an opposing second side edge of the first end panel of the two end panels;
- a third outer reinforcing corner panel extending from a first side edge of a second end panel of the two end panels; and
- a fourth outer reinforcing corner panel extending from an opposing second side edge of the second end panel of the two end panels.

7. A blank in accordance with claim 1 further comprising:
- a first top panel extending from a top edge of a first end panel of the two end panels; and
- a second top panel extending from a top edge of a second end panel of the two end panels.

8. A blank in accordance with claim 1 further comprising:
- a first top panel extending from a top edge of the first side panel; and a second top panel extending from a top edge of a second side panel of the two side panels.

9. A blank in accordance with claim 1 further comprising a support panel extending from a side edge of the inner side panel.

10. A polygonal container formed from a blank of sheet material, said container comprising:

a bottom wall;

two opposing side walls, each side wall emanating from a side edge of the bottom wall;

two opposing end walls, each end wall emanating from an end edge of the bottom wall; and a first reinforcing panel assembly extending between a first end wall of the two end walls and a first side wall of the two side walls, the first reinforcing panel assembly comprising:

a corner panel emanating from a side edge of the first side wall, the corner panel having a first width and a first height;

a first reinforcing end panel emanating from a side edge of the corner panel;

a second reinforcing end panel emanating from a side edge of the first reinforcing end panel; and an inner reinforcing corner panel emanating from a side edge of the second reinforcing panel, the inner reinforcing corner panel having a second width substantially equal to the first width, the inner reinforcing corner panel having a second height substantially equal to the first height.

11. A polygonal container in accordance with claim 10, further comprising:

a second reinforcing panel assembly extending between the first end wall and a second side wall of the two side walls;

a third reinforcing panel assembly extending between the second side wall and a second end wall of the two end walls; and a fourth reinforcing panel assembly extending between the first side wall and the second end wall.

12. A polygonal container in accordance with claim 10, wherein the first reinforcing panel assembly further comprises an inner side panel at least partially overlying and attached to the first side wall.

13. A polygonal container in accordance with claim 12, wherein the first reinforcing end panel is at least partially overlying and attached to the first end wall.

14. A polygonal container in accordance with claim 12 further comprising a top wall comprising:

a first top panel extending from the first end wall; and a second top panel extending from a second end wall of the two end walls.

15. A polygonal container in accordance with claim 12 further comprising a top wall comprising:

a first top panel extending from the first side wall; and a second top panel extending from a second side wall of the two side walls.

16. A polygonal container in accordance with claim 15, wherein the top wall comprises a first top shoulder and a second top shoulder.

17. A polygonal container in accordance with claim 12 further comprising an outer reinforcing corner panel at least partially overlying and attached to the corner panel.

18. A polygonal container in accordance with claim 17 further comprising a top wall comprising:

a first top panel extending from the first end wall; and a second top panel extending from a second end wall of the two end walls.

19. A polygonal container in accordance with claim 17 further comprising a top wall comprising:

a first top panel extending from the first side wall; and a second top panel extending from a second side wall of the two side walls.

20. A polygonal container in accordance with claim 12 wherein the first reinforcing panel assembly further comprises:

a support panel extending from a side edge of the inner side panel, the support panel forming a portion of a first support wall extending from the first side wall into a cavity of said container.

21. A method for forming a polygonal container from a blank of sheet material, the polygonal container including at least five sides, the blank having a bottom panel, two opposing side panels each extending from a respective side edge of the bottom panel, two opposing end panels each extending from a respective end edge of the bottom panel, and a reinforcing panel assembly extending from a first side edge of a first side panel of the two side panels, wherein the reinforcing panel assembly includes a corner panel extending from the first side edge of the first side panel, a first reinforcing end panel extending from a side edge of the corner panel, a second reinforcing end panel extending from a side edge of the first reinforcing end panel, an inner reinforcing corner panel extending from a side edge of the second reinforcing end panel, and an inner side panel extending from a side edge of the inner reinforcing corner panel, and wherein the corner panel has a first width and a first height and the inner reinforcing corner panel has a second width substantially equal to the first width and a second height substantially equal to the first height, wherein the method comprises:

rotating the second reinforcing end panel toward an interior surface of the first reinforcing end panel about a fold line connecting the second reinforcing end panel and the first reinforcing end panel, said rotating aligning the first and second reinforcing end panels in a substantially face-to-face relationship, the corner panel and the inner reinforcing corner panel in a substantially face-to-face relationship, and the inner side panel and the first side panel in a substantially face-to-face relationship;

rotating the first and second reinforcing end panels toward an interior surface of the first side panel about a fold line connecting the second reinforcing end panel and the inner reinforcing corner panel and about a fold line connecting the first reinforcing end panel and the corner panel;

rotating the corner panel and the inner reinforcing corner panel toward the interior surface of the first side panel about a fold line connecting the inner reinforcing corner panel and the inner side panel and about a fold line connecting the corner panel and the first side panel; and rotating the first side panel inward into a substantially perpendicular relationship with the bottom panel about a fold line connecting the first side panel and the bottom panel, the first side panel and inner side panel forming a first side wall of the polygonal container and the corner panel and the inner reinforcing corner panel forming a first corner wall of the polygonal container.

22. A method in accordance with claim 21 further comprising:

rotating a first end panel of the two end panels inwardly into a substantially perpendicular relationship with the bottom panel; and attaching an interior surface of the first end panel to an exterior surface of the first reinforcing end panel, the first end panel and the first and second reinforcing end panels forming the first end wall of the polygonal container.

23. A method in accordance with claim 22, wherein the blank includes an outer reinforcing corner panel extending from a side edge of the first end panel, said method further comprising:

rotating the outer reinforcing corner panel toward the interior surface of the first end panel about a fold line connecting the outer reinforcing corner panel and the first end panel; and attaching an interior surface of the outer reinforcing corner panel to an exterior surface of the corner panel, the outer reinforcing corner panel, the corner panel, and the inner reinforcing corner panel forming the first corner wall.

24. A method in accordance with claim 22, wherein the blank includes a first top panel extending from a top edge of the first end panel, said method further comprising rotating the first top panel toward the interior surface of the first end panel about a fold line connecting the first top panel and the first end panel, the first top panel forming at least a portion of a top wall of the polygonal container.

25. A method in accordance with claim 21, wherein the blank includes a first top panel extending from a top edge of the first side panel, said method further comprising rotating the first top panel toward an interior surface of the first side panel about a fold line connecting the first top panel and the first side panel, the first top panel forming at least a portion of a top wall of the polygonal container.

26. A method in accordance with claim 21, wherein the blank includes a support panel extending from a side edge of the inner side panel, said method further comprising rotating the support panel toward the exterior surface of the inner side panel about a fold line connecting the support panel and the inner side panel, the support panel forming a portion of a support wall of the polygonal container.

27. A method in accordance with claim 21, wherein the blank includes a plurality of reinforcing panel assemblies, one reinforcing panel assembly of the plurality of reinforcing panel assembly extends from each of the first side edge and an opposing second side edge of each side panel, said method further comprising:

rotating a corner panel, a first reinforcing end panel, a second reinforcing end panel, an inner reinforcing corner panel, and an inner side panel of a first reinforcing panel assembly of the plurality of reinforcing panel assemblies about a plurality of fold lines to form the first corner wall;

rotating a corner panel, a first reinforcing end panel, a second reinforcing end panel, an inner reinforcing corner panel, and an inner side panel of a second reinforcing panel assembly of the plurality of reinforcing panel assemblies about a plurality of fold lines to form a second corner wall;

rotating a corner panel, a first reinforcing end panel, a second reinforcing end panel, an inner reinforcing corner panel, and an inner side panel of a third reinforcing panel assembly of the plurality of reinforcing panel assemblies about a plurality of fold lines to form a third corner wall; and rotating a corner panel, a first reinforcing end panel, a second reinforcing end panel, an inner reinforcing corner panel, and an inner side panel of a fourth reinforcing panel assembly of the plurality of reinforcing panel assemblies about a plurality of fold lines to form a fourth corner wall.

* * * * *